US011318734B2

(12) United States Patent
Chechik et al.

(10) Patent No.: US 11,318,734 B2
(45) Date of Patent: May 3, 2022

(54) FRICTION REDUCTION MEANS FOR PRINTING SYSTEMS AND METHOD

(71) Applicant: LANDA CORPORATION LTD., Rehovot (IL)

(72) Inventors: Helena Chechik, Rehovot (IL); Shoham Livaderu, Moshav Sitriyya (IL); Matan Bar-On, Hod Hasharon (IL); Zohar Goldenstein, Nes Ziona (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

(21) Appl. No.: 17/279,539

(22) PCT Filed: Oct. 2, 2019

(86) PCT No.: PCT/IB2019/058380

§ 371 (c)(1),
(2) Date: Mar. 24, 2021

(87) PCT Pub. No.: WO2020/075012

PCT Pub. Date: Apr. 16, 2020

(65) Prior Publication Data

US 2021/0394531 A1 Dec. 23, 2021

Related U.S. Application Data

(60) Provisional application No. 62/742,531, filed on Oct. 8, 2018.

(51) Int. Cl.
*G03G 21/00* (2006.01)
*G03G 15/00* (2006.01)
(Continued)

(52) U.S. Cl.
CPC ..... *B41J 2/01* (2013.01); *B41J 2/2103* (2013.01); *B41J 11/005* (2013.01); *B41J 2002/012* (2013.01); *B41P 2213/46* (2013.01)

(58) Field of Classification Search
CPC .. B41M 5/508; B41J 2002/012; B41J 2/0057; B41J 2/01; B41J 2/2103; B41J 11/007; B41J 15/04
See application file for complete search history.

(56) References Cited

U.S. PATENT DOCUMENTS 2,839,181 A 6/1958 Renner
3,011,545 A 12/1961 Welsh et al.
(Continued)

FOREIGN PATENT DOCUMENTS

CN 1121033 A 4/1996
CN 1200085 A 11/1998
(Continued)

OTHER PUBLICATIONS

JP2008183744A Machine Translation (by EPO and Google)—published Aug. 14, 2008, Fuji Xerox Co Ltd.
(Continued)

*Primary Examiner* — John Zimmermann
(74) *Attorney, Agent, or Firm* — Momentum IP; Marc Van Dyke

(57) ABSTRACT

A friction reduction system for reducing friction of an intermediate transfer member (ITM) of a printing system, while the ITM is guided along the printing system by a guiding arrangement. The friction reduction system includes a fluid reservoir mounted within the printing system, a fluid depositing arrangement disposed along the ITM, and a control mechanism, adapted to control depositing of fluid, from the fluid depositing arrangement onto the guiding arrangement or onto at least a portion of the ITM. Depos-
(Continued)

iting of the fluid reduces friction between the ITM and the guiding arrangement.

20 Claims, 7 Drawing Sheets

(51) Int. Cl.

| | |
|---|---|
| ***B41J 2/01*** | (2006.01) |
| ***B41J 2/21*** | (2006.01) |
| *B41J 11/00* | (2006.01) |

(56) References Cited

U.S. PATENT DOCUMENTS 3,053,319 A 9/1962 Cronin et al.
3,697,551 A 10/1972 Thomson
3,697,568 A 10/1972 Boissieras et al.
3,889,802 A 6/1975 Jonkers
3,898,670 A 8/1975 Erikson et al.
3,947,113 A 3/1976 Buchan et al.
4,009,958 A 3/1977 Kurita et al.
4,093,764 A 6/1978 Duckett et al.
4,293,866 A 10/1981 Takita et al.
4,401,500 A 8/1983 Hamada et al.
4,535,694 A 8/1985 Fukuda
4,538,156 A 8/1985 Durkee et al.
4,555,437 A 11/1985 Tanck
4,575,465 A 3/1986 Viola
4,642,654 A 2/1987 Toganoh et al.
4,853,737 A 8/1989 Hartley et al.
4,976,197 A 12/1990 Yamanari et al.
5,012,072 A 4/1991 Martin et al.
5,039,339 A 8/1991 Phan et al.
5,062,364 A 11/1991 Lewis et al.
5,075,731 A 12/1991 Kamimura et al.
5,099,256 A 3/1992 Anderson
5,106,417 A 4/1992 Hauser et al.
5,128,091 A 7/1992 Agur et al.
5,190,582 A 3/1993 Shinozuka et al.
5,198,835 A 3/1993 Ando et al.
5,246,100 A 9/1993 Stone et al.
5,264,904 A 11/1993 Audi et al.
5,305,099 A 4/1994 Morcos
5,333,771 A 8/1994 Cesario
5,349,905 A 9/1994 Taylor et al.
5,352,507 A 10/1994 Bresson et al.
5,365,324 A 11/1994 Gu et al.
5,406,884 A 4/1995 Okuda et al.
5,471,233 A 11/1995 Okamoto et al.
5,532,314 A 7/1996 Sexsmith
5,552,875 A 9/1996 Sagiv et al.
5,575,873 A 11/1996 Pieper et al.
5,587,779 A 12/1996 Heeren et al.
5,608,004 A 3/1997 Toyoda et al.
5,613,669 A 3/1997 Grueninger
5,614,933 A 3/1997 Hindman et al.
5,623,296 A 4/1997 Fujino et al.
5,642,141 A 6/1997 Hale et al.
5,660,108 A 8/1997 Pensavecchia
5,677,719 A 10/1997 Granzow
5,679,463 A 10/1997 Visser et al.
5,698,018 A 12/1997 Bishop et al.
5,723,242 A 3/1998 Woo et al.
5,733,698 A 3/1998 Lehman et al.
5,736,250 A 4/1998 Heeks et al.
5,772,746 A 6/1998 Sawada et al.
5,777,576 A 7/1998 Zur et al.
5,777,650 A 7/1998 Blank
5,841,456 A 11/1998 Takei et al.
5,859,076 A 1/1999 Kozma et al.
5,865,299 A * 2/1999 Williams ..... B65G 15/60 198/811
5,880,214 A 3/1999 Okuda
5,883,144 A 3/1999 Bambara et al.
5,883,145 A 3/1999 Hurley et al.
5,884,559 A 3/1999 Okubo et al.
5,889,534 A 3/1999 Johnson et al.
5,891,934 A 4/1999 Moffatt et al.
5,895,711 A 4/1999 Yamaki et al.
5,902,841 A 5/1999 Jaeger et al.
5,923,929 A 7/1999 Ben et al.
5,929,129 A 7/1999 Feichtinger
5,932,659 A 8/1999 Bambara et al.
5,935,751 A 8/1999 Matsuoka et al.
5,978,631 A 11/1999 Lee
5,978,638 A 11/1999 Tanaka et al.
5,991,590 A 11/1999 Chang et al.
6,004,647 A 12/1999 Bambara et al.
6,009,284 A 12/1999 Weinberger et al.
6,024,018 A 2/2000 Darel et al.
6,024,786 A 2/2000 Gore
6,033,049 A 3/2000 Fukuda
6,045,817 A 4/2000 Ananthapadmanabhan et al.
6,053,438 A 4/2000 Romano, Jr. et al.
6,055,396 A 4/2000 Pang
6,059,407 A 5/2000 Komatsu et al.
6,071,368 A 6/2000 Boyd et al.
6,072,976 A 6/2000 Kuriyama et al.
6,078,775 A 6/2000 Arai et al.
6,094,558 A 7/2000 Shimizu et al.
6,102,538 A 8/2000 Ochi et al.
6,103,775 A 8/2000 Bambara et al.
6,108,513 A 8/2000 Landa et al.
6,109,746 A 8/2000 Jeanmaire et al.
6,132,541 A 10/2000 Heaton
6,143,807 A 11/2000 Lin et al.
6,166,105 A 12/2000 Santilli et al.
6,195,112 B1 2/2001 Fassler et al.
6,196,674 B1 3/2001 Takemoto
6,213,580 B1 4/2001 Segerstrom et al.
6,214,894 B1 4/2001 Bambara et al.
6,221,928 B1 4/2001 Kozma et al.
6,234,625 B1 5/2001 Wen
6,242,503 B1 6/2001 Kozma et al.
6,257,716 B1 7/2001 Yanagawa et al.
6,261,688 B1 7/2001 Kaplan et al.
6,262,137 B1 7/2001 Kozma et al.
6,262,207 B1 7/2001 Rao et al.
6,303,215 B1 10/2001 Sonobe et al.
6,316,512 B1 11/2001 Bambara et al.
6,332,943 B1 12/2001 Herrmann et al.
6,335,046 B1 * 1/2002 Mackey ..... A21C 7/01 425/332
6,354,700 B1 3/2002 Roth
6,357,869 B1 3/2002 Rasmussen et al.
6,357,870 B1 3/2002 Beach et al.
6,358,660 B1 3/2002 Agler et al.
6,363,234 B2 3/2002 Landa et al.
6,364,451 B1 4/2002 Silverbrook
6,377,772 B1 4/2002 Chowdry et al.
6,383,278 B1 5/2002 Hirasa et al.
6,386,697 B1 5/2002 Yamamoto et al.
6,390,617 B1 5/2002 Iwao
6,396,528 B1 5/2002 Yanagawa
6,397,034 B1 5/2002 Tarnawskyj et al.
6,400,913 B1 6/2002 De Jong et al.
6,402,317 B2 6/2002 Yanagawa et al.
6,409,331 B1 6/2002 Gelbart
6,432,501 B1 8/2002 Yang et al.
6,438,352 B1 8/2002 Landa et al.
6,454,378 B1 9/2002 Silverbrook et al.
6,471,803 B1 10/2002 Pelland et al.
6,530,321 B2 3/2003 Andrew et al.
6,530,657 B2 3/2003 Polierer
6,531,520 B1 3/2003 Bambara et al.
6,551,394 B2 4/2003 Hirasa et al.
6,551,716 B1 4/2003 Landa et al.
6,554,189 B1 4/2003 Good et al.
6,559,969 B1 5/2003 Lapstun
6,575,547 B2 6/2003 Sakuma
6,586,100 B1 7/2003 Pickering et al.
6,590,012 B2 7/2003 Miyabayashi
6,608,979 B1 8/2003 Landa et al.
6,623,817 B1 9/2003 Yang et al.

(56) References Cited

U.S. PATENT DOCUMENTS

| | | | |
|---|---|---|---|
| 6,630,047 | B2 | 10/2003 | Jing et al. |
| 6,639,527 | B2 | 10/2003 | Johnson |
| 6,648,468 | B2 | 11/2003 | Shinkoda et al. |
| 6,678,068 | B1 | 1/2004 | Richter et al. |
| 6,682,189 | B2 | 1/2004 | May et al. |
| 6,685,769 | B1 | 2/2004 | Karl et al. |
| 6,704,535 | B2 | 3/2004 | Kobayashi et al. |
| 6,709,096 | B1 | 3/2004 | Beach et al. |
| 6,716,562 | B2 | 4/2004 | Uehara et al. |
| 6,719,423 | B2 | 4/2004 | Chowdry et al. |
| 6,720,367 | B2 | 4/2004 | Taniguchi et al. |
| 6,755,519 | B2 | 6/2004 | Gelbart et al. |
| 6,761,446 | B2 | 7/2004 | Chowdry et al. |
| 6,770,331 | B1 | 8/2004 | Mielke et al. |
| 6,789,887 | B2 | 9/2004 | Yang et al. |
| 6,811,840 | B1 | 11/2004 | Cross |
| 6,827,018 | B1 | 12/2004 | Hartmann et al. |
| 6,881,458 | B2 | 4/2005 | Ludwig et al. |
| 6,898,403 | B2 | 5/2005 | Baker et al. |
| 6,912,952 | B1 | 7/2005 | Landa et al. |
| 6,916,862 | B2 | 7/2005 | Ota et al. |
| 6,917,437 | B1 | 7/2005 | Myers et al. |
| 6,966,712 | B2 | 11/2005 | Trelewicz et al. |
| 6,970,674 | B2 | 11/2005 | Sato et al. |
| 6,974,022 | B2 | 12/2005 | Saeki |
| 6,982,799 | B2 | 1/2006 | Lapstun |
| 6,983,692 | B2 | 1/2006 | Beauchamp et al. |
| 7,025,453 | B2 | 4/2006 | Ylitalo et al. |
| 7,057,760 | B2 | 6/2006 | Lapstun et al. |
| 7,084,202 | B2 | 8/2006 | Pickering et al. |
| 7,128,412 | B2 | 10/2006 | King et al. |
| 7,129,858 | B2 | 10/2006 | Ferran et al. |
| 7,134,953 | B2 | 11/2006 | Reinke |
| 7,160,377 | B2 | 1/2007 | Zoch et al. |
| 7,204,584 | B2 | 4/2007 | Lean et al. |
| 7,213,900 | B2 | 5/2007 | Ebihara |
| 7,224,478 | B1 | 5/2007 | Lapstun et al. |
| 7,265,819 | B2 | 9/2007 | Raney |
| 7,271,213 | B2 | 9/2007 | Hoshida et al. |
| 7,296,882 | B2 | 11/2007 | Buehler et al. |
| 7,300,133 | B1 | 11/2007 | Folkins et al. |
| 7,300,147 | B2 | 11/2007 | Johnson |
| 7,304,753 | B1 | 12/2007 | Richter et al. |
| 7,322,689 | B2 | 1/2008 | Kohne et al. |
| 7,334,520 | B2 | 2/2008 | Geissler et al. |
| 7,348,368 | B2 | 3/2008 | Kakiuchi et al. |
| 7,360,887 | B2 | 4/2008 | Konno |
| 7,362,464 | B2 | 4/2008 | Kitazawa |
| 7,459,491 | B2 | 12/2008 | Tyvoll et al. |
| 7,527,359 | B2 | 5/2009 | Stevenson et al. |
| 7,575,314 | B2 | 8/2009 | Desie et al. |
| 7,612,125 | B2 | 11/2009 | Muller et al. |
| 7,655,707 | B2 | 2/2010 | Ma |
| 7,655,708 | B2 | 2/2010 | House et al. |
| 7,699,922 | B2 | 4/2010 | Breton et al. |
| 7,708,371 | B2 | 5/2010 | Yamanobe |
| 7,709,074 | B2 | 5/2010 | Uchida et al. |
| 7,712,890 | B2 | 5/2010 | Yahiro |
| 7,732,543 | B2 | 6/2010 | Loch et al. |
| 7,732,583 | B2 | 6/2010 | Annoura et al. |
| 7,808,670 | B2 | 10/2010 | Lapstun et al. |
| 7,810,922 | B2 | 10/2010 | Gervasi et al. |
| 7,845,788 | B2 | 12/2010 | Oku |
| 7,867,327 | B2 | 1/2011 | Sano et al. |
| 7,876,345 | B2 | 1/2011 | Houjou |
| 7,910,183 | B2 | 3/2011 | Wu |
| 7,919,544 | B2 | 4/2011 | Matsuyama et al. |
| 7,942,516 | B2 | 5/2011 | Ohara et al. |
| 7,977,408 | B2 | 7/2011 | Matsuyama et al. |
| 7,985,784 | B2 | 7/2011 | Kanaya et al. |
| 8,002,400 | B2 | 8/2011 | Kibayashi et al. |
| 8,012,538 | B2 | 9/2011 | Yokouchi |
| 8,025,389 | B2 | 9/2011 | Yamanobe et al. |
| 8,038,284 | B2 | 10/2011 | Hori et al. |
| 8,041,275 | B2 | 10/2011 | Soria et al. |
| 8,042,906 | B2 | 10/2011 | Chiwata et al. |
| 8,059,309 | B2 | 11/2011 | Lapstun et al. |
| 8,095,054 | B2 | 1/2012 | Nakamura |
| 8,109,595 | B2 | 2/2012 | Tanaka et al. |
| 8,119,315 | B1 | 2/2012 | Heuft et al. |
| 8,122,846 | B2 | 2/2012 | Stiblert et al. |
| 8,147,055 | B2 | 4/2012 | Cellura et al. |
| 8,162,428 | B2 | 4/2012 | Eun et al. |
| 8,177,351 | B2 | 5/2012 | Taniuchi et al. |
| 8,186,820 | B2 | 5/2012 | Chiwata |
| 8,192,904 | B2 | 6/2012 | Nagai et al. |
| 8,215,762 | B2 | 7/2012 | Ageishi |
| 8,242,201 | B2 | 8/2012 | Goto et al. |
| 8,256,857 | B2 | 9/2012 | Folkins et al. |
| 8,263,683 | B2 | 9/2012 | Gibson et al. |
| 8,264,135 | B2 | 9/2012 | Ozolins et al. |
| 8,295,733 | B2 | 10/2012 | Imoto |
| 8,303,071 | B2 | 11/2012 | Eun |
| 8,303,072 | B2 | 11/2012 | Shibata et al. |
| 8,304,043 | B2 | 11/2012 | Nagashima et al. |
| 8,353,589 | B2 | 1/2013 | Ikeda et al. |
| 8,434,847 | B2 | 5/2013 | Dejong et al. |
| 8,460,450 | B2 | 6/2013 | Taverizatshy et al. |
| 8,469,476 | B2 | 6/2013 | Mandel et al. |
| 8,474,963 | B2 | 7/2013 | Hasegawa et al. |
| 8,536,268 | B2 | 9/2013 | Karjala et al. |
| 8,546,466 | B2 | 10/2013 | Yamashita et al. |
| 8,556,400 | B2 | 10/2013 | Yatake et al. |
| 8,693,032 | B2 | 4/2014 | Goddard et al. |
| 8,711,304 | B2 | 4/2014 | Mathew et al. |
| 8,714,731 | B2 | 5/2014 | Leung et al. |
| 8,746,873 | B2 | 6/2014 | Tsukamoto et al. |
| 8,779,027 | B2 | 7/2014 | Idemura et al. |
| 8,802,221 | B2 | 8/2014 | Noguchi et al. |
| 8,867,097 | B2 | 10/2014 | Mizuno |
| 8,885,218 | B2 | 11/2014 | Hirose |
| 8,891,128 | B2 | 11/2014 | Yamazaki |
| 8,894,198 | B2 | 11/2014 | Hook et al. |
| 8,919,946 | B2 | 12/2014 | Suzuki et al. |
| 9,004,629 | B2 | 4/2015 | De Jong et al. |
| 9,186,884 | B2 | 11/2015 | Landa et al. |
| 9,227,429 | B1 | 1/2016 | LeStrange et al. |
| 9,229,664 | B2 | 1/2016 | Landa et al. |
| 9,264,559 | B2 | 2/2016 | Motoyanagi et al. |
| 9,284,469 | B2 | 3/2016 | Song et al. |
| 9,290,016 | B2 | 3/2016 | Landa et al. |
| 9,327,496 | B2 | 5/2016 | Landa et al. |
| 9,353,273 | B2 | 5/2016 | Landa et al. |
| 9,381,736 | B2 | 7/2016 | Landa et al. |
| 9,446,586 | B2 | 9/2016 | Matos et al. |
| 9,498,946 | B2 | 11/2016 | Landa et al. |
| 9,505,208 | B2 | 11/2016 | Shmaiser et al. |
| 9,517,618 | B2 | 12/2016 | Landa et al. |
| 9,566,780 | B2 | 2/2017 | Landa et al. |
| 9,568,862 | B2 | 2/2017 | Shmaiser et al. |
| 9,643,400 | B2 | 5/2017 | Landa et al. |
| 9,643,403 | B2 | 5/2017 | Landa et al. |
| 9,776,391 | B2 | 10/2017 | Landa et al. |
| 9,782,993 | B2 | 10/2017 | Landa et al. |
| 9,849,667 | B2 | 12/2017 | Landa et al. |
| 9,884,479 | B2 | 2/2018 | Landa et al. |
| 9,902,147 | B2 | 2/2018 | Shmaiser et al. |
| 9,914,316 | B2 | 3/2018 | Landa et al. |
| 10,065,411 | B2 | 9/2018 | Landa et al. |
| 10,175,613 | B2 | 1/2019 | Watanabe |
| 10,179,447 | B2 | 1/2019 | Shmaiser et al. |
| 10,190,012 | B2 | 1/2019 | Landa et al. |
| 10,195,843 | B2 | 2/2019 | Landa et al. |
| 10,201,968 | B2 | 2/2019 | Landa et al. |
| 10,226,920 | B2 | 3/2019 | Shmaiser et al. |
| 10,266,711 | B2 | 4/2019 | Landa et al. |
| 10,300,690 | B2 | 5/2019 | Landa et al. |
| 10,357,963 | B2 | 7/2019 | Landa et al. |
| 10,357,985 | B2 | 7/2019 | Landa et al. |
| 10,427,399 | B2 | 10/2019 | Shmaiser et al. |
| 10,434,761 | B2 | 10/2019 | Landa et al. |
| 10,477,188 | B2 | 11/2019 | Stiglic et al. |
| 10,518,526 | B2 | 12/2019 | Landa et al. |
| 10,569,532 | B2 | 2/2020 | Shmaiser et al. |

(56) References Cited

U.S. PATENT DOCUMENTS 10,569,533 B2 2/2020 Landa et al.
10,569,534 B2 2/2020 Shmaiser et al.
10,576,734 B2 3/2020 Landa et al.
10,596,804 B2 3/2020 Landa et al.
10,632,740 B2 4/2020 Landa et al.
10,642,198 B2 5/2020 Landa et al.
10,703,094 B2 7/2020 Shmaiser et al.
10,730,333 B2 8/2020 Landa et al.
10,759,953 B2 9/2020 Landa et al.
10,800,936 B2 10/2020 Landa et al.
10,828,888 B2 11/2020 Landa et al.
10,889,128 B2 1/2021 Landa et al.
10,926,532 B2 2/2021 Chechik et al.
10,933,661 B2 3/2021 Landa et al.
10,960,660 B2 3/2021 Landa et al.
10,981,377 B2 4/2021 Landa et al.
10,994,528 B1 5/2021 Burkatovsky
2001/0022607 A1 9/2001 Takahashi et al.
2002/0041317 A1 4/2002 Kashiwazaki et al.
2002/0064404 A1 5/2002 Iwai
2002/0102374 A1 8/2002 Gervasi et al.
2002/0121220 A1 9/2002 Lin
2002/0150408 A1 10/2002 Mosher et al.
2002/0164494 A1 11/2002 Grant et al.
2002/0197481 A1 12/2002 Jing et al.
2003/0004025 A1 1/2003 Okuno et al.
2003/0007055 A1 1/2003 Ogawa
2003/0018119 A1 1/2003 Frenkel et al.
2003/0030686 A1 2/2003 Abe et al.
2003/0032700 A1 2/2003 Morrison et al.
2003/0043258 A1 3/2003 Kerr et al.
2003/0054139 A1 3/2003 Ylitalo et al.
2003/0055129 A1 3/2003 Alford
2003/0063179 A1 4/2003 Adachi
2003/0064317 A1 4/2003 Bailey et al.
2003/0081964 A1 5/2003 Shimura et al.
2003/0118381 A1 6/2003 Law et al.
2003/0129435 A1 7/2003 Blankenship et al.
2003/0186147 A1 10/2003 Pickering et al.
2003/0214568 A1 11/2003 Nishikawa et al.
2003/0234849 A1 12/2003 Pan et al.
2004/0003863 A1 1/2004 Eckhardt
2004/0020382 A1 2/2004 McLean et al.
2004/0036758 A1 2/2004 Sasaki et al.
2004/0047666 A1 3/2004 Imaizumi et al.
2004/0087707 A1 5/2004 Zoch et al.
2004/0123761 A1 7/2004 Szumla et al.
2004/0125188 A1 7/2004 Szumla et al.
2004/0145643 A1 7/2004 Nakamura
2004/0173111 A1 9/2004 Okuda
2004/0200369 A1 10/2004 Brady
2004/0228642 A1 11/2004 Iida et al.
2004/0246324 A1 12/2004 Nakashima
2004/0246326 A1 12/2004 Dwyer et al.
2004/0252175 A1 12/2004 Bejat et al.
2005/0031807 A1 2/2005 Quintens et al.
2005/0082146 A1 4/2005 Axmann
2005/0110855 A1 5/2005 Taniuchi et al.
2005/0111861 A1 5/2005 Calamita et al.
2005/0134874 A1 6/2005 Overall et al.
2005/0150408 A1 7/2005 Hesterman
2005/0185009 A1 8/2005 Claramunt et al.
2005/0195235 A1 9/2005 Kitao
2005/0235870 A1 10/2005 Ishihara
2005/0266332 A1 12/2005 Pavlisko et al.
2005/0272334 A1 12/2005 Wang et al.
2006/0004123 A1 1/2006 Wu et al.
2006/0135709 A1 6/2006 Hasegawa et al.
2006/0164488 A1 7/2006 Taniuchi et al.
2006/0164489 A1 7/2006 Vega et al.
2006/0192827 A1 8/2006 Takada et al.
2006/0233578 A1 10/2006 Maki et al.
2006/0286462 A1 12/2006 Jackson et al.
2007/0014595 A1 1/2007 Kawagoe
2007/0025768 A1 2/2007 Komatsu et al.
2007/0029171 A1 2/2007 Nemedi
2007/0045939 A1 3/2007 Toya et al.
2007/0054981 A1 3/2007 Yanagi et al.
2007/0064077 A1 3/2007 Konno
2007/0077520 A1 4/2007 Maemoto
2007/0120927 A1 5/2007 Snyder et al.
2007/0123642 A1 5/2007 Banning et al.
2007/0134030 A1 6/2007 Lior et al.
2007/0144368 A1 6/2007 Barazani et al.
2007/0146462 A1 6/2007 Taniuchi et al.
2007/0147894 A1 6/2007 Yokota et al.
2007/0166071 A1 7/2007 Shima
2007/0176995 A1 8/2007 Kadomatsu et al.
2007/0189819 A1 8/2007 Uehara et al.
2007/0199457 A1 8/2007 Cyman et al.
2007/0229639 A1 10/2007 Yahiro
2007/0253726 A1 11/2007 Kagawa
2007/0257955 A1 11/2007 Tanaka et al.
2007/0285486 A1 12/2007 Harris et al.
2008/0006176 A1 1/2008 Houjou
2008/0030536 A1 2/2008 Furukawa et al.
2008/0032072 A1 2/2008 Taniuchi et al.
2008/0044587 A1 2/2008 Maeno et al.
2008/0055356 A1 3/2008 Yamanobe
2008/0055381 A1 3/2008 Doi et al.
2008/0074462 A1 3/2008 Hirakawa
2008/0112912 A1 5/2008 Springob et al.
2008/0124158 A1 5/2008 Folkins
2008/0138546 A1 6/2008 Soria et al.
2008/0166495 A1 7/2008 Maeno et al.
2008/0167185 A1 7/2008 Hirota
2008/0175612 A1 7/2008 Oikawa et al.
2008/0196612 A1 8/2008 Rancourt et al.
2008/0196621 A1 8/2008 Ikuno et al.
2008/0213548 A1 9/2008 Koganehira et al.
2008/0236480 A1 10/2008 Furukawa et al.
2008/0253812 A1 10/2008 Pearce et al.
2009/0022504 A1 1/2009 Kuwabara et al.
2009/0041515 A1 2/2009 Kim
2009/0041932 A1 2/2009 Ishizuka et al.
2009/0064884 A1 3/2009 Hook et al.
2009/0074492 A1 3/2009 Ito
2009/0082503 A1 3/2009 Yanagi et al.
2009/0087565 A1 4/2009 Houjou
2009/0098385 A1 4/2009 Kaemper et al.
2009/0116885 A1 5/2009 Ando
2009/0148200 A1 6/2009 Hara et al.
2009/0165937 A1 7/2009 Inoue et al.
2009/0190951 A1 7/2009 Torimaru et al.
2009/0202275 A1 8/2009 Nishida et al.
2009/0211490 A1 8/2009 Ikuno et al.
2009/0220873 A1 9/2009 Enomoto et al.
2009/0237479 A1 9/2009 Yamashita et al.
2009/0256896 A1 10/2009 Scarlata
2009/0279170 A1 11/2009 Miyazaki et al.
2009/0315926 A1 12/2009 Yamanobe
2009/0317555 A1 12/2009 Hori
2009/0318591 A1 12/2009 Ageishi et al.
2010/0012023 A1 1/2010 Lefevre et al.
2010/0053292 A1 3/2010 Thayer et al.
2010/0053293 A1 3/2010 Thayer et al.
2010/0066796 A1 3/2010 Yanagi et al.
2010/0075843 A1 3/2010 Ikuno et al.
2010/0086692 A1 4/2010 Ohta et al.
2010/0091064 A1 4/2010 Araki et al.
2010/0225695 A1 9/2010 Fujikura
2010/0231623 A1 9/2010 Hirato
2010/0239789 A1 9/2010 Umeda
2010/0245511 A1 9/2010 Ageishi
2010/0282100 A1 11/2010 Okuda et al.
2010/0285221 A1 11/2010 Oki et al.
2010/0303504 A1 12/2010 Funamoto et al.
2010/0310281 A1 12/2010 Miura et al.
2011/0044724 A1 2/2011 Funamoto et al.
2011/0058001 A1 3/2011 Gila et al.
2011/0058859 A1 3/2011 Nakamatsu et al.
2011/0085828 A1 4/2011 Kosako et al.
2011/0128300 A1 6/2011 Gay et al.
2011/0141188 A1 6/2011 Morita

(56) References Cited

U.S. PATENT DOCUMENTS

2011/0149002 A1 6/2011 Kessler
2011/0150509 A1 6/2011 Komiya
2011/0150541 A1 6/2011 Michibata
2011/0169889 A1 7/2011 Kojima et al.
2011/0195260 A1 8/2011 Lee et al.
2011/0199414 A1 8/2011 Lang
2011/0234683 A1 9/2011 Komatsu
2011/0234689 A1 9/2011 Saito
2011/0249090 A1 10/2011 Moore et al.
2011/0269885 A1 11/2011 Imai
2011/0279554 A1 11/2011 Dannhauser et al.
2011/0304674 A1 12/2011 Sambhy et al.
2012/0013693 A1 1/2012 Tasaka et al.
2012/0013694 A1 1/2012 Kanke
2012/0013928 A1 1/2012 Yoshida et al.
2012/0026224 A1 2/2012 Anthony et al.
2012/0039647 A1 2/2012 Brewington et al.
2012/0094091 A1 4/2012 Van Mil et al.
2012/0098882 A1 4/2012 Onishi et al.
2012/0105561 A1 5/2012 Taniuchi et al.
2012/0105562 A1 5/2012 Sekiguchi et al.
2012/0113180 A1 5/2012 Tanaka et al.
2012/0113203 A1 5/2012 Kushida et al.
2012/0127250 A1 5/2012 Kanasugi et al.
2012/0127251 A1 5/2012 Tsuji et al.
2012/0140009 A1 6/2012 Kanasugi et al.
2012/0154497 A1 6/2012 Nakao et al.
2012/0156375 A1 6/2012 Brust et al.
2012/0156624 A1 6/2012 Rondon et al.
2012/0162302 A1 6/2012 Oguchi et al.
2012/0163846 A1 6/2012 Andoh et al.
2012/0194830 A1 8/2012 Gaertner et al.
2012/0237260 A1 9/2012 Sengoku et al.
2012/0287260 A1 11/2012 Lu et al.
2012/0301186 A1 11/2012 Yang et al.
2012/0314077 A1 12/2012 Clavenna, II et al.
2013/0011158 A1 1/2013 Meguro et al.
2013/0017006 A1 1/2013 Suda
2013/0044188 A1 2/2013 Nakamura et al.
2013/0057603 A1 3/2013 Gordon
2013/0088543 A1 4/2013 Tsuji et al.
2013/0120513 A1 5/2013 Thayer et al.
2013/0201237 A1 8/2013 Thomson et al.
2013/0234080 A1 9/2013 Torikoshi et al.
2013/0242016 A1 9/2013 Edwards et al.
2013/0302065 A1 11/2013 Mori et al.
2013/0338273 A1 12/2013 Shimanaka et al.
2014/0001013 A1 1/2014 Takifuji et al.
2014/0011125 A1 1/2014 Inoue et al.
2014/0043398 A1 2/2014 Butler et al.
2014/0104360 A1 4/2014 Häcker et al.
2014/0153956 A1 6/2014 Yonemoto
2014/0168330 A1 6/2014 Liu et al.
2014/0175707 A1 6/2014 Wolk et al.
2014/0232782 A1 8/2014 Mukai et al.
2014/0267777 A1 9/2014 Le Clerc et al.
2014/0334855 A1 11/2014 Onishi et al.
2014/0339056 A1 11/2014 Iwakoshi et al.
2015/0024648 A1 1/2015 Landa et al.
2015/0025179 A1 1/2015 Landa et al.
2015/0072090 A1 3/2015 Landa et al.
2015/0085036 A1 3/2015 Liu et al.
2015/0085037 A1 3/2015 Liu et al.
2015/0116408 A1 4/2015 Armbruster et al.
2015/0118503 A1 4/2015 Landa et al.
2015/0195509 A1 7/2015 Phipps
2015/0210065 A1 7/2015 Kelly et al.
2015/0304531 A1 10/2015 Rodriguez et al.
2015/0336378 A1 11/2015 Guttmann et al.
2015/0361288 A1 12/2015 Song et al.
2016/0031246 A1 2/2016 Sreekumar et al.
2016/0222232 A1 8/2016 Landa et al.
2016/0250879 A1 9/2016 Chen et al.
2016/0286462 A1 9/2016 Gohite et al.
2016/0375680 A1 12/2016 Nishitani et al.
2017/0028688 A1 2/2017 Dannhauser et al.
2017/0104887 A1 4/2017 Nomura
2018/0259888 A1 9/2018 Mitsui et al.
2018/0348672 A1 12/2018 Yoshida
2018/0348675 A1 12/2018 Nakamura et al.
2019/0016114 A1 1/2019 Sugiyama et al.
2019/0094727 A1 3/2019 Landa et al.
2019/0152218 A1 5/2019 Stein et al.
2019/0218411 A1 7/2019 Landa et al.
2020/0156366 A1 5/2020 Shmaiser et al.
2020/0171813 A1 6/2020 Chechik et al.
2020/0276801 A1 9/2020 Landa et al.
2020/0290340 A1* 9/2020 Chechik ..... B41J 2/01
2020/0314413 A1 10/2020 Stiglic et al.
2020/0326646 A1 10/2020 Landa et al.
2020/0353746 A1 11/2020 Landa et al.
2020/0361202 A1 11/2020 Burkatovsky
2020/0376878 A1 12/2020 Landa et al.
2020/0384758 A1 12/2020 Shmaiser et al.
2021/0001622 A1 1/2021 Landa et al.
2021/0053341 A1 2/2021 Landa et al.
2021/0062021 A1 3/2021 Landa et al.
2021/0070038 A1 3/2021 Pomerantz et al.
2021/0070083 A1 3/2021 Levanon et al.
2021/0095145 A1 4/2021 Landa et al.
2021/0146697 A1 5/2021 Landa et al.
2021/0182001 A1 6/2021 Levant

FOREIGN PATENT DOCUMENTS

CN 1212229 A 3/1999
CN 1324901 A 12/2001
CN 1445622 A 10/2003
CN 1493514 A 5/2004
CN 1535235 A 10/2004
CN 1555422 A 12/2004
CN 1680506 A 10/2005
CN 1720187 A 1/2006
CN 1261831 C 6/2006
CN 1809460 A 7/2006
CN 1289368 C 12/2006
CN 101073937 A 11/2007
CN 101177057 A 5/2008
CN 101249768 A 8/2008
CN 101344746 A 1/2009
CN 101359210 A 2/2009
CN 101396910 A 4/2009
CN 101508200 A 8/2009
CN 101519007 A 9/2009
CN 101524916 A 9/2009
CN 101544100 A 9/2009
CN 101544101 A 9/2009
CN 101607468 A 12/2009
CN 201410787 Y 2/2010
CN 101835611 A 9/2010
CN 101835612 A 9/2010
CN 101873982 A 10/2010
CN 102229294 A 11/2011
CN 102248776 A 11/2011
CN 102300932 A 12/2011
CN 102648095 A 8/2012
CN 102925002 A 2/2013
CN 103045008 A 4/2013
CN 103309213 A 9/2013
CN 103568483 A 2/2014
CN 103627337 A 3/2014
CN 104220934 A 12/2014
CN 104271356 A 1/2015
CN 104284850 A 1/2015
CN 104618642 A 5/2015
CN 105058999 A 11/2015
CN 102555450 B 3/2016
CN 103991293 B 1/2017
CN 107111267 A 8/2017
DE 102010060999 A1 6/2012
EP 0457551 A2 11/1991
EP 0499857 A1 8/1992
EP 0606490 A1 7/1994
EP 0609076 A2 8/1994

(56) References Cited

FOREIGN PATENT DOCUMENTS

| | | | |
|---|---|---|---|
| EP | 0613791 | A2 | 9/1994 |
| EP | 0530627 | B1 | 3/1997 |
| EP | 0784244 | A2 | 7/1997 |
| EP | 0835762 | A1 | 4/1998 |
| EP | 0843236 | A2 | 5/1998 |
| EP | 0854398 | A2 | 7/1998 |
| EP | 1013466 | A2 | 6/2000 |
| EP | 1146090 | A2 | 10/2001 |
| EP | 1158029 | A1 | 11/2001 |
| EP | 0825029 | B1 | 5/2002 |
| EP | 1247821 | A2 | 10/2002 |
| EP | 1271263 | A1 | 1/2003 |
| EP | 0867483 | B1 | 6/2003 |
| EP | 0923007 | B1 | 3/2004 |
| EP | 1454968 | A1 | 9/2004 |
| EP | 1503326 | A1 | 2/2005 |
| EP | 1777243 | A1 | 4/2007 |
| EP | 2028238 | A1 | 2/2009 |
| EP | 2042317 | A1 | 4/2009 |
| EP | 2065194 | A2 | 6/2009 |
| EP | 2228210 | A1 | 9/2010 |
| EP | 2270070 | A1 | 1/2011 |
| EP | 2042318 | B1 | 2/2011 |
| EP | 2042325 | B1 | 2/2012 |
| EP | 2634010 | A1 | 9/2013 |
| EP | 2683556 | A1 | 1/2014 |
| EP | 2075635 | B1 | 10/2014 |
| EP | 3260486 | A1 | 12/2017 |
| EP | 2823363 | B1 | 10/2018 |
| GB | 748821 | A | 5/1956 |
| GB | 1496016 | A | 12/1977 |
| GB | 1520932 | A | 8/1978 |
| GB | 1522175 | A | 8/1978 |
| GB | 2321430 | A | 7/1998 |
| JP | S5578904 | A | 6/1980 |
| JP | S57121446 | U | 7/1982 |
| JP | S6076343 | A | 4/1985 |
| JP | S60199692 | A | 10/1985 |
| JP | S6223783 | A | 1/1987 |
| JP | H03248170 | A | 11/1991 |
| JP | H05147208 | A | 6/1993 |
| JP | H05192871 | A | 8/1993 |
| JP | H05297737 | A | 11/1993 |
| JP | H06954 | A | 1/1994 |
| JP | H06100807 | A | 4/1994 |
| JP | H06171076 | A | 6/1994 |
| JP | H06345284 | A | 12/1994 |
| JP | H07112841 | A | 5/1995 |
| JP | H07186453 | A | 7/1995 |
| JP | H07238243 | A | 9/1995 |
| JP | H0862999 | A | 3/1996 |
| JP | H08112970 | A | 5/1996 |
| JP | 2529651 | B2 | 8/1996 |
| JP | H09123432 | A | 5/1997 |
| JP | H09157559 | A | 6/1997 |
| JP | H09281851 | A | 10/1997 |
| JP | H09300678 | A | 11/1997 |
| JP | H09314867 | A | 12/1997 |
| JP | H1142811 | A | 2/1999 |
| JP | H11503244 | A | 3/1999 |
| JP | H11106081 | A | 4/1999 |
| JP | H11138740 | A | 5/1999 |
| JP | H11245383 | A | 9/1999 |
| JP | 2000108320 | A | 4/2000 |
| JP | 2000108334 | A | 4/2000 |
| JP | 2000141710 | A | 5/2000 |
| JP | 2000168062 | A | 6/2000 |
| JP | 2000169772 | A | 6/2000 |
| JP | 2000206801 | A | 7/2000 |
| JP | 2000343025 | A | 12/2000 |
| JP | 2001088430 | A | 4/2001 |
| JP | 2001098201 | A | 4/2001 |
| JP | 2001139865 | A | 5/2001 |
| JP | 3177985 | B2 | 6/2001 |
| JP | 2001164165 | A | 6/2001 |
| JP | 2001199150 | A | 7/2001 |
| JP | 2001206522 | A | 7/2001 |
| JP | 2002020666 | A | 1/2002 |
| JP | 2002049211 | A | 2/2002 |
| JP | 2002504446 | A | 2/2002 |
| JP | 2002069346 | A | 3/2002 |
| JP | 2002103598 | A | 4/2002 |
| JP | 2002169383 | A | 6/2002 |
| JP | 2002229276 | A | 8/2002 |
| JP | 2002234243 | A | 8/2002 |
| JP | 2002278365 | A | 9/2002 |
| JP | 2002304066 | A | 10/2002 |
| JP | 2002326733 | A | 11/2002 |
| JP | 2002371208 | A | 12/2002 |
| JP | 2003057967 | A | 2/2003 |
| JP | 2003094795 | A | 4/2003 |
| JP | 2003114558 | A | 4/2003 |
| JP | 2003145914 | A | 5/2003 |
| JP | 2003183557 | A | 7/2003 |
| JP | 2003211770 | A | 7/2003 |
| JP | 2003219271 | A | 7/2003 |
| JP | 2003246135 | A | 9/2003 |
| JP | 2003246484 | A | 9/2003 |
| JP | 2003292855 | A | 10/2003 |
| JP | 2003313466 | A | 11/2003 |
| JP | 2004009632 | A | 1/2004 |
| JP | 2004011263 | A | 1/2004 |
| JP | 2004019022 | A | 1/2004 |
| JP | 2004025708 | A | 1/2004 |
| JP | 2004034441 | A | 2/2004 |
| JP | 2004077669 | A | 3/2004 |
| JP | 2004114377 | A | 4/2004 |
| JP | 2004114675 | A | 4/2004 |
| JP | 2004148687 | A | 5/2004 |
| JP | 2004167902 | A | 6/2004 |
| JP | 2004231711 | A | 8/2004 |
| JP | 2004524190 | A | 8/2004 |
| JP | 2004261975 | A | 9/2004 |
| JP | 2004325782 | A | 11/2004 |
| JP | 2005014255 | A | 1/2005 |
| JP | 2005014256 | A | 1/2005 |
| JP | 2005114769 | A | 4/2005 |
| JP | 2005215247 | A | 8/2005 |
| JP | 2005307184 | A | 11/2005 |
| JP | 2005319593 | A | 11/2005 |
| JP | 2006001688 | A | 1/2006 |
| JP | 2006023403 | A | 1/2006 |
| JP | 2006095870 | A | 4/2006 |
| JP | 2006102975 | A | 4/2006 |
| JP | 2006137127 | A | 6/2006 |
| JP | 2006143778 | A | 6/2006 |
| JP | 2006152133 | A | 6/2006 |
| JP | 2006224583 | A | 8/2006 |
| JP | 2006231666 | A | 9/2006 |
| JP | 2006234212 | A | 9/2006 |
| JP | 2006243212 | A | 9/2006 |
| JP | 2006263984 | A | 10/2006 |
| JP | 2006347081 | A | 12/2006 |
| JP | 2006347085 | A | 12/2006 |
| JP | 2007025246 | A | 2/2007 |
| JP | 2007041530 | A | 2/2007 |
| JP | 2007069584 | A | 3/2007 |
| JP | 2007079159 | A | 3/2007 |
| JP | 2007083445 | A | 4/2007 |
| JP | 2007190745 | A | 8/2007 |
| JP | 2007216673 | A | 8/2007 |
| JP | 2007253347 | A | 10/2007 |
| JP | 2007334125 | A | 12/2007 |
| JP | 2008006816 | A | 1/2008 |
| JP | 2008018716 | A | 1/2008 |
| JP | 2008019286 | A | 1/2008 |
| JP | 2008036968 | A | 2/2008 |
| JP | 2008137146 | A | 6/2008 |
| JP | 2008137239 | A | 6/2008 |
| JP | 2008139877 | A | 6/2008 |
| JP | 2008142962 | A | 6/2008 |
| JP | 2008183744 | A | 8/2008 |
| JP | 2008194997 | A | 8/2008 |
| JP | 2008532794 | A | 8/2008 |

(56) References Cited

FOREIGN PATENT DOCUMENTS

| | | | |
|---|---|---|---|
| JP | 2008201564 | A | 9/2008 |
| JP | 2008238674 | A | 10/2008 |
| JP | 2008246787 | A | 10/2008 |
| JP | 2008246990 | A | 10/2008 |
| JP | 2008254203 | A | 10/2008 |
| JP | 2008255135 | A | 10/2008 |
| JP | 2009040892 | A | 2/2009 |
| JP | 2009045794 | A | 3/2009 |
| JP | 2009045851 | A | 3/2009 |
| JP | 2009045885 | A | 3/2009 |
| JP | 2009083314 | A | 4/2009 |
| JP | 2009083317 | A | 4/2009 |
| JP | 2009083325 | A | 4/2009 |
| JP | 2009096175 | A | 5/2009 |
| JP | 2009148908 | A | 7/2009 |
| JP | 2009154330 | A | 7/2009 |
| JP | 2009190375 | A | 8/2009 |
| JP | 2009202355 | A | 9/2009 |
| JP | 2009214318 | A | 9/2009 |
| JP | 2009214439 | A | 9/2009 |
| JP | 2009226805 | A | 10/2009 |
| JP | 2009226852 | A | 10/2009 |
| JP | 2009226886 | A | 10/2009 |
| JP | 2009226890 | A | 10/2009 |
| JP | 2009233977 | A | 10/2009 |
| JP | 2009234219 | A | 10/2009 |
| JP | 2010005815 | A | 1/2010 |
| JP | 2010054855 | A | 3/2010 |
| JP | 2010510357 | A | 4/2010 |
| JP | 2010105365 | A | 5/2010 |
| JP | 2010173201 | A | 8/2010 |
| JP | 2010184376 | A | 8/2010 |
| JP | 2010214885 | A | 9/2010 |
| JP | 2010228192 | A | 10/2010 |
| JP | 2010228392 | A | 10/2010 |
| JP | 2010234599 | A | 10/2010 |
| JP | 2010234681 | A | 10/2010 |
| JP | 2010240897 | A | 10/2010 |
| JP | 2010241073 | A | 10/2010 |
| JP | 2010247381 | A | 11/2010 |
| JP | 2010247528 | A | 11/2010 |
| JP | 2010258193 | A | 11/2010 |
| JP | 2010260204 | A | 11/2010 |
| JP | 2010260287 | A | 11/2010 |
| JP | 2010260302 | A | 11/2010 |
| JP | 2010286570 | A | 12/2010 |
| JP | 2011002532 | A | 1/2011 |
| JP | 2011025431 | A | 2/2011 |
| JP | 2011031619 | A | 2/2011 |
| JP | 2011037070 | A | 2/2011 |
| JP | 2011067956 | A | 4/2011 |
| JP | 2011126031 | A | 6/2011 |
| JP | 2011133884 | A | 7/2011 |
| JP | 2011144271 | A | 7/2011 |
| JP | 2011523601 | A | 8/2011 |
| JP | 2011173325 | A | 9/2011 |
| JP | 2011173326 | A | 9/2011 |
| JP | 2011186346 | A | 9/2011 |
| JP | 2011189627 | A | 9/2011 |
| JP | 2011201951 | A | 10/2011 |
| JP | 2011224032 | A | 11/2011 |
| JP | 2012042943 | A | 3/2012 |
| JP | 2012086499 | A | 5/2012 |
| JP | 2012111194 | A | 6/2012 |
| JP | 2012126123 | A | 7/2012 |
| JP | 2012139905 | A | 7/2012 |
| JP | 2012196787 | A | 10/2012 |
| JP | 2012201419 | A | 10/2012 |
| JP | 2013001081 | A | 1/2013 |
| JP | 2013060299 | A | 4/2013 |
| JP | 2013091313 | A | 5/2013 |
| JP | 2013103474 | A | 5/2013 |
| JP | 2013121671 | A | 6/2013 |
| JP | 2013129158 | A | 7/2013 |
| JP | 2014047005 | A | 3/2014 |
| JP | 2014094827 | A | 5/2014 |
| JP | 2014131843 | A | 7/2014 |
| JP | 2015517928 | A | 6/2015 |
| JP | 2016093999 | A | 5/2016 |
| JP | 2016185688 | A | 10/2016 |
| JP | 2016539830 | A | 12/2016 |
| RU | 2180675 | C2 | 3/2002 |
| RU | 2282643 | C1 | 8/2006 |
| WO | WO-8600327 | A1 | 1/1986 |
| WO | WO-9307000 | A1 | 4/1993 |
| WO | WO-9401283 | A1 | 1/1994 |
| WO | WO-9604339 | A1 | 2/1996 |
| WO | WO-9631809 | A1 | 10/1996 |
| WO | WO-9707991 | A1 | 3/1997 |
| WO | WO-9736210 | A1 | 10/1997 |
| WO | WO-9821251 | A1 | 5/1998 |
| WO | WO-9855901 | A1 | 12/1998 |
| WO | WO-9912633 | A1 | 3/1999 |
| WO | WO-9942509 | A1 | 8/1999 |
| WO | WO-9943502 | A2 | 9/1999 |
| WO | WO-0064685 | A1 | 11/2000 |
| WO | WO-0154902 | A1 | 8/2001 |
| WO | WO-0170512 | A1 | 9/2001 |
| WO | WO-02068191 | A1 | 9/2002 |
| WO | WO-02078868 | A2 | 10/2002 |
| WO | WO-02094912 | A1 | 11/2002 |
| WO | WO-2004113082 | A1 | 12/2004 |
| WO | WO-2004113450 | A1 | 12/2004 |
| WO | WO-2006051733 | A1 | 5/2006 |
| WO | WO-2006069205 | A1 | 6/2006 |
| WO | WO-2006073696 | A1 | 7/2006 |
| WO | WO-2006091957 | A2 | 8/2006 |
| WO | WO-2007009871 | A2 | 1/2007 |
| WO | WO-2007145378 | A1 | 12/2007 |
| WO | WO-2008078841 | A1 | 7/2008 |
| WO | WO-2009025809 | A1 | 2/2009 |
| WO | WO-2009134273 | A1 | 11/2009 |
| WO | WO-2010042784 | A3 | 7/2010 |
| WO | WO-2010073916 | A1 | 7/2010 |
| WO | WO-2011142404 | A1 | 11/2011 |
| WO | WO-2012014825 | A1 | 2/2012 |
| WO | WO-2012148421 | A1 | 11/2012 |
| WO | WO-2013060377 | A1 | 5/2013 |
| WO | WO-2013087249 | A1 | 6/2013 |
| WO | WO-2013132339 | A1 | 9/2013 |
| WO | WO-2013132340 | A1 | 9/2013 |
| WO | WO-2013132343 | A1 | 9/2013 |
| WO | WO-2013132345 | A1 | 9/2013 |
| WO | WO-2013132356 | A1 | 9/2013 |
| WO | WO-2013132418 | A2 | 9/2013 |
| WO | WO-2013132419 | A1 | 9/2013 |
| WO | WO-2013132420 | A1 | 9/2013 |
| WO | WO-2013132424 | A1 | 9/2013 |
| WO | WO-2013132432 | A1 | 9/2013 |
| WO | WO-2013132438 | A2 | 9/2013 |
| WO | WO-2013132439 | A1 | 9/2013 |
| WO | WO-2013136220 | A1 | 9/2013 |
| WO | WO-2015036864 | A1 | 3/2015 |
| WO | WO-2015036906 | A1 | 3/2015 |
| WO | WO-2015036960 | A1 | 3/2015 |
| WO | WO-2016166690 | A1 | 10/2016 |
| WO | WO-2017208155 | A1 | 12/2017 |
| WO | WO-2017208246 | A1 | 12/2017 |
| WO | WO-2018100541 | A1 | 6/2018 |

OTHER PUBLICATIONS

"Amino Functional Silicone Polymers", in Xiameter.Copyrgt. 2009 Dow Corning Corporation.

BASF , "JONCRYL 537", Datasheet, Retrieved from the internet: Mar. 23, 2007 p. 1.

Clariant., "Ultrafine Pigment Dispersion for Design and Creative Materials: Hostafine Pigment Preparation" Jun. 19, 2008. Retrieved from the Internet: [URL: http://www.clariant.com/C125720D002B963C/4352D0BC052E90CEC1257479002707D9/$FILE/DP6208E_0608_FL_Hostafinefordesignandcreativematerials.pdf].

CN101073937A Machine Translation (by EPO and Google)—published Nov. 21, 2007; Werner Kaman Maschinen Gmbh & [DE].

(56) References Cited

OTHER PUBLICATIONS

CN101177057 Machine Translation (by EPO and Google)—published May 14, 2008—Hangzhou Yuanyang Industry Co.
CN101249768A Machine Translation (by EPO and Google)—published Aug. 27, 2008; Shantou Xinxie Special Paper T [CN].
CN101344746A Machine Translation (by EPO and Google)—published Jan. 14, 2009; Ricoh KK [JP].
CN101359210A Machine Translation (by EPO and Google)—published Feb. 4, 2009; Canon KK [JP].
CN101524916A Machine Translation (by EPO and Google)—published Sep. 9, 2009; Fuji Xerox Co Ltd.
CN101544100A Machine Translation (by EPO and Google)—published Sep. 30, 2009; Fuji Xerox Co Ltd.
CN101873982A Machine Translation (by EPO and Google)—published Oct. 27, 2010; Habasit AG, Delair et al.
CN102229294A Machine Translation (by EPO and Google)—published Nov. 2, 2011; Guangzhou Changcheng Ceramics Co Ltd.
CN102300932A Machine Translation (by EPO and Google)—published Dec. 28, 2011; Yoshida Hiroaki et al.
CN102648095A Machine Translation (by EPO and Google)—published Aug. 22, 2012; Mars Inc.
CN102925002 Machine Translation (by EPO and Google)—published Feb. 13, 2013; Jiangnan University, Fu et al.
CN103045008A Machine Translation (by EPO and Google)—published Apr. 17, 2013; Fuji Xerox Co Ltd.
CN103568483A Machine Translation (by EPO and Google)—published Feb. 12, 2014; Anhui Printing Mechanical & Electrical Co Ltd.
CN103627337A Machine Translation (by EPO and Google)—published Mar. 12, 2014; Suzhou Banlid New Material Co Ltd.
CN103991293A Machine Translation (by EPO and Google)—published Aug. 20, 2014; Miyakoshi Printing Machinery Co., Ltd, Junichi et al.
CN103991293B Machine Translation (by EPO and Google)—issued on Jan. 4, 2017; Miyakoshi Printing Machinery Co., Ltd, Junichi et al.
CN104618642 Machine Translation (by EPO and Google); published on May 13, 2015, Yulong Comp Comm Tech Shenzhen.
CN105058999A Machine Translation (by EPO and Google)—published Nov. 18, 2015; Zhuoli Imaging Technology Co Ltd.
CN107111267A Machine Translation (by EPO and Google)—published Aug. 29, 2017; Hewlett Packard Indigo BV.
CN1121033A Machine Translation (by EPO and Google)—published Apr. 24, 1996; Kuehnle Manfred R [US].
CN1212229A Machine Translation (by EPO and Google)—published Mar. 31, 1999; Honta Industry Corp [JP].
CN1493514A Machine Translation (by EPO and Google)—published May 5, 2004; GD SPA, Boderi et al.
CN1555422A Machine Translation (by EPO and Google)—published Dec. 15, 2004; Noranda Inc.
CN1680506A Machine Translation (by EPO and Google)—published Oct. 12, 2005; Shinetsu Chemical Co [JP].
CN1809460A Machine Translation (by EPO and Google)—published Jul. 26, 2006; Canon KK.
CN201410787Y Machine Translation (by EPO and Google)—published Feb. 24, 2010; Zhejiang Chanx Wood Co Ltd.
Co-pending U.S. Appl. No. 16/590,397, filed Oct. 2, 2019.
Co-pending U.S. Appl. No. 17/155,121, filed Jan. 22, 2021.
Co-pending U.S. Appl. No. 17/157,767, filed Jan. 25, 2021.
Co-pending U.S. Appl. No. 17/184,411, inventor Landa; Benzion, filed Feb. 24, 2021.
Co-pending U.S. Appl. No. 17/186,043, inventor Landa, filed Feb. 26, 2021.
Co-pending U.S. Appl. No. 17/221,817, inventor Burkatovsky; Vitaly, filed Apr. 4, 2021.
Co-pending U.S. Appl. No. 17/252,747, inventors Benzion; Landa et al., filed Dec. 16, 2020.
Co-pending U.S. Appl. No. 17/265,817, inventors Alon; Siman Tov et al., filed Feb. 4, 2021.
DE102010060999 Machine Translation (by EPO and Google)—published Jun. 6, 2012; Wolf, Roland, Dr.-Ing.
Epomin Polyment, product information from Nippon Shokubai, dated Feb. 28, 2014.
Flexicon., "Bulk Handling Equipment and Systems: Carbon Black," 2018, 2 pages.
Furia, T.E.,"CRC Handbook of Food Additives, Second Edition, vol. 1" CRC Press LLC, 1972, p. 434.
Handbook of Print Media, 2001, Springer Verlag, Berlin/Heidelberg/New York, pp. 127-136,748—With English Translation.
IP.com Search, 2018, 2 pages.
IP.com Search, 2019, 1 page.
IP.com search (Year: 2021).
JP2000108320 Machine Translation (by PlatPat English machine translation)—published Apr. 18, 2000 Brother Ind. Ltd.
JP2000108334A Machine Translation (by EPO and Google)—published Apr. 18, 2000; Brother Ind Ltd.
JP2000141710A Machine Translation (by EPO and Google)—published May 23, 2000; Brother Ind Ltd.
JP2000168062A Machine Translation (by EPO and Google)—published Jun. 20, 2000; Brother Ind Ltd.
JP2000169772 Machine Translation (by EPO and Google)—published Jun. 20, 2000; Tokyo Ink MFG Co Ltd.
JP2000206801 Machine Translation (by PlatPat English machine translation); published on Jul. 28, 2000, Canon KK, Kobayashi et al.
JP2000343025A Machine Translation (by EPO and Google)—published Dec. 12, 2000; Kyocera Corp.
JP2001088430A Machine Translation (by EPO and Google)—published Apr. 3, 2001; Kimoto KK.
JP2001098201A Machine Translation (by EPO and Google)—published Apr. 10, 2001; Eastman Kodak Co.
JP2001139865A Machine Translation (by EPO and Google)—published May 22, 2001; Sharp KK.
JP2001164165A Machine Translation (by EPO and Google)—published Jun. 19, 2001; Dainippon Ink & Chemicals.
JP2001199150A Machine Translation (by EPO and Google)—published Jul. 24, 2001; Canon KK.
JP2001206522 Machine Translation (by EPO, PlatPat and Google)—published Jul. 31, 2001; Nitto Denko Corp, Kato et al.
JP2002049211A Machine Translation (by EPO and Google)—published Feb. 15, 2002; PFU Ltd.
JP2002069346A Machine Translation (by EPO and Google)—published Mar. 8, 2002; Dainippon Ink & Chemicals.
JP2002103598A Machine Translation (by EPO and Google)—published Apr. 9, 2002; Olympus Optical Co.
JP2002169383 Machine Translation (by EPO, PlatPat and Google)—published Jun. 14, 2002 Ricoh KK.
JP2002234243 Machine Translation (by EPO and Google)—published Aug. 20, 2002; Hitachi Koki Co Ltd.
JP2002278365 Machine Translation (by PlatPat English machine translation)—published Sep. 27, 2002 Katsuaki, Ricoh KK.
JP2002304066A Machine Translation (by EPO and Google)—published Oct. 18, 2002; PFU Ltd.
JP2002326733 Machine Translation (by EPO, PlatPat and Google)—published Nov. 12, 2002; Kyocera Mita Corp.
JP2002371208 Machine Translation (by EPO and Google)—published Dec. 26, 2002; Canon Inc.
JP2003094795A Machine Translation (by EPO and Google)—published Apr. 3, 2003; Ricoh KK.
JP2003114558 Machine Translation (by EPO, PlatPat and Google)—published Apr. 18, 2003 Mitsubishi Chem Corp, Yuka Denshi Co Ltd, et al.
JP2003145914A Machine Translation (by EPO and Google)—published May 21, 2003; Konishiroku Photo Ind.
JP2003211770 Machine Translation (by EPO and Google)—published Jul. 29, 2003 Hitachi Printing Solutions.
JP2003219271 Machine Translation (by EPO and Google); published on Jul. 31, 2003, Japan Broadcasting.
JP2003246135 Machine Translation (by PlatPat English machine translation)—published Sep. 2, 2003 Ricoh KK, Morohoshi et al.
JP2003246484 Machine Translation (English machine translation)—published Sep. 2, 2003 Kyocera Corp.

(56) References Cited

OTHER PUBLICATIONS

JP2003292855A Machine Translation (by EPO and Google)—published Oct. 15, 2003; Konishiroku Photo Ind.
JP2003313466A Machine Translation (by EPO and Google)—published Nov. 6, 2003; Ricoh KK.
JP2004009632A Machine Translation (by EPO and Google)—published Jan. 15, 2004; Konica Minolta Holdings Inc.
JP2004011263A Machine Translation (by EPO and Google)—published Jan. 15, 2004; Sumitomo Denko Steel Wire KK.
JP2004019022 Machine Translation (by EPO and Google)—published Jan. 22, 2004; Yamano et al.
JP2004025708A Machine Translation (by EPO and Google)—published Jan. 29, 2004; Konica Minolta Holdings Inc.
JP2004034441A Machine Translation (by EPO and Google)—published Feb. 5, 2004; Konica Minolta Holdings Inc.
JP2004077669 Machine Translation (by PlatPat English machine translation)—published Mar. 11, 2004 Fuji Xerox Co Ltd.
JP2004114377(A) Machine Translation (by EPO and Google)—published Apr. 15, 2004; Konica Minolta Holdings Inc, et al.
JP2004114675 Machine Translation (by EPO and Google)—published Apr. 15, 2004; Canon Inc.
JP2004148687A Machine Translation (by EPO and Google)—published May 27, 2014; Mitsubishi Heavy Ind Ltd.
JP2004167902A Machine Translation (by EPO and Google)—published Jun. 17, 2004; Nippon New Chrome KK.
JP2004231711 Machine Translation (by EPO and Google)—published Aug. 19, 2004; Seiko Epson Corp.
JP2004261975 Machine Translation (by EPO, PlatPat and Google); published on Sep. 24, 2004, Seiko Epson Corp, Kataoka et al.
JP2004325782A Machine Translation (by EPO and Google)—published Nov. 18, 2004; Canon KK.
JP2004524190A Machine Translation (by EPO and Google)—published Aug. 12, 2004; Avery Dennison Corp.
JP2005014255 Machine Translation (by EPO and Google)—published Jan. 20, 2005; Canon Inc.
JP2005014256 Machine Translation (by EPO and Google)—published Jan. 20, 2005; Canon Inc.
JP2005114769 Machine Translation (by PlatPat English machine translation)—published Apr. 28, 2005 Ricoh KK.
JP2005215247A Machine Translation (by EPO and Google)—published Aug. 11, 2005; Toshiba Corp.
JP2005319593 Machine Translation (by EPO and Google)—published Nov. 17, 2005, Jujo Paper Co Ltd.
JP2006001688 Machine Translation (by PlatPat English machine translation)—published Jan. 5, 2006 Ricoh KK.
JP2006023403A Machine Translation (by EPO and Google)—published Jan. 26, 2006; Ricoh KK.
JP2006095870A Machine Translation (by EPO and Google)—published Apr. 13, 2006; Fuji Photo Film Co Ltd.
JP2006102975 Machine Translation (by EPO and Google)—published Apr. 20, 2006; Fuji Photo Film Co Ltd.
JP2006137127 Machine Translation (by EPO and Google)—published Jun. 1, 2006; Konica Minolta Med & Graphic.
JP2006143778 Machine Translation (by EPO, PlatPat and Google)—published Jun. 8, 2006 Sun Bijutsu Insatsu KK et al.
JP2006152133 Machine Translation (by EPO, PlatPat and Google)—published Jun. 15, 2006 Seiko Epson Corp.
JP2006224583A Machine Translation (by EPO and Google)—published Aug. 31, 2006; Konica Minolta Holdings Inc.
JP2006231666A Machine Translation (by EPO and Google)—published Sep. 7, 2006; Seiko Epson Corp.
JP2006234212A Machine Translation (by EPO and Google)—published Sep. 7, 2006; Matsushita Electric Ind Co Ltd.
JP2006243212 Machine Translation (by PlatPat English machine translation)—published Sep. 14, 2006 Fuji Xerox Co Ltd.
JP2006263984 Machine Translation (by EPO, PlatPat and Google)—published Oct. 5, 2006 Fuji Photo Film Co Ltd.
JP2006347081 Machine Translation (by EPO and Google)—published Dec. 28, 2006; Fuji Xerox Co Ltd.
JP2006347085 Machine Translation (by EPO and Google)—published Dec. 28, 2006 Fuji Xerox Co Ltd.
JP2007025246A Machine Translation (by EPO and Google)—published Feb. 1, 2007; Seiko Epson Corp.
JP2007041530A Machine Translation (by EPO and Google)—published Feb. 15, 2007; Fuji Xerox Co Ltd.
JP2007069584 Machine Translation (by EPO and Google)—published Mar. 22, 2007 Fujifilm.
JP2007079159A Machine Translation (by EPO and Google)—published Mar. 29, 2007; Ricoh KK.
JP2007083445A Machine Translation (by EPO and Google)—published Apr. 5, 2007; Fujifilm Corp.
JP2007216673 Machine Translation (by EPO and Google)—published Aug. 30, 2007 Brother Ind.
JP2007253347A Machine Translation (by EPO and Google)—published Oct. 4, 2007; Ricoh KK, Matsuo et al.
JP2008006816 Machine Translation (by EPO and Google)—published Jan. 17, 2008; Fujifilm Corp.
JP2008018716 Machine Translation (by EPO and Google)—published Jan. 31, 2008; Canon Inc.
JP2008137146A Machine Translation (by EPO and Google)—published Jun. 19, 2008; CBG Acciai Srl.
JP2008137239A Machine Translation (by EPO and Google); published on Jun. 19, 2008, Kyocera Mita Corp.
JP2008142962 Machine Translation (by EPO and Google)—published Jun. 26, 2008; Fuji Xerox Co Ltd.
JP2008194997A Machine Translation (by EPO and Google)—published Aug. 28, 2008; Fuji Xerox Co Ltd.
JP2008201564 Machine Translation (English machine translation)—published Sep. 4, 2008 Fuji Xerox Co Ltd.
JP2008238674A Machine Translation (by EPO and Google)—published Oct. 9, 2008; Brother Ind Ltd.
JP2008246990 Machine Translation (by EPO and Google)—published Oct. 16, 2008, Jujo Paper Co Ltd.
JP2008254203A Machine Translation (by EPO and Google)—published Oct. 23, 2008; Fujifilm Corp.
JP2008255135 Machine Translation (by EPO and Google)—published Oct. 23, 2008; Fujifilm Corp.
JP2009045794 Machine Translation (by EPO and Google)—published Mar. 5, 2009; Fujifilm Corp.
JP2009045851A Machine Translation (by EPO and Google); published on Mar. 5, 2009, Fujifilm Corp.
JP2009045885A Machine Translation (by EPO and Google)—published Mar. 5, 2009; Fuji Xerox Co Ltd.
JP2009083314 Machine Translation (by EPO, PlatPat and Google)—published Apr. 23, 2009 Fujifilm Corp.
JP2009083317 Abstract; Machine Translation (by EPO and Google)—published Apr. 23, 2009; Fuji Film Corp.
JP2009083325 Abstract; Machine Translation (by EPO and Google)—published Apr. 23, 2009 Fujifilm.
JP2009096175 Machine Translation (EPO, PlatPat and Google) published on May 7, 2009 Fujifilm Corp.
JP2009148908A Machine Translation (by EPO and Google)—published Jul. 9, 2009; Fuji Xerox Co Ltd.
JP2009154330 Machine Translation (by EPO and Google)—published Jul. 16, 2009; Seiko Epson Corp.
JP2009190375 Machine Translation (by EPO and Google)—published Aug. 27, 2009; Fuji Xerox Co Ltd.
JP2009202355 Machine Translation (by EPO and Google)—published Sep. 10, 2009; Fuji Xerox Co Ltd.
JP2009214318 Machine Translation (by EPO and Google)—published Sep. 24, 2009 Fuji Xerox Co Ltd.
JP2009214439 Machine Translation (by PlatPat English machine translation)—published Sep. 24, 2009 Fujifilm Corp.
JP2009226805A Machine Translation (by EPO and Google)—published Oct. 8, 2009; Fuji Xerox Co Ltd.
JP2009226852 Machine Translation (by EPO and Google)—published Oct. 8, 2009; Hirato Katsuyuki, Fujifilm Corp.
JP2009226890A Machine Translation (by EPO and Google)—published Oct. 8, 2009; Fuji Xerox Co Ltd.
JP2009233977 Machine Translation (by EPO and Google)—published Oct. 15, 2009; Fuji Xerox Co Ltd.

(56) References Cited

OTHER PUBLICATIONS

JP2009234219 Machine Translation (by EPO and Google)—published Oct. 15, 2009; Fujifilm Corp.
JP2010054855 Machine Translation (by PlatPat English machine translation)—published Mar. 11, 2010 Itatsu, Fuji Xerox Co.
JP2010105365 Machine Translation (by EPO and Google)—published May 13, 2010; Fuji Xerox Co Ltd.
JP2010173201 Abstract; Machine Translation (by EPO and Google)—published Aug. 12, 2010; Richo Co Ltd.
JP2010184376 Machine Translation (by EPO, PlatPat and Google)—published Aug. 26, 2010 Fujifilm Corp.
JP2010214885A Machine Translation (by EPO and Google)—published Sep. 30, 2010; Mitsubishi Heavy Ind Ltd.
JP2010228192 Machine Translation (by PlatPat English machine translation)—published Oct. 14, 2010 Fuji Xerox.
JP2010228392A Machine Translation (by EPO and Google)—published Oct. 14, 2010; Jujo Paper Co Ltd.
JP2010234599A Machine Translation (by EPO and Google)—published Oct. 21, 2010; Duplo Seiko Corp et al.
JP2010234681A Machine Translation (by EPO and Google)—published Oct. 21, 2010; Riso Kagaku Corp.
JP2010240897A Machine Translation (by EPO and Google)—published Oct. 28, 2010; Toppan Printing Co Ltd.
JP2010241073 Machine Translation (by EPO and Google)—published Oct. 28, 2010; Canon Inc.
JP2010247381A Machine Translation (by EPO and Google); published on Nov. 4, 2010, Ricoh Co Ltd.
JP2010258193 Machine Translation (by EPO and Google)—published Nov. 11, 2010; Seiko Epson Corp.
JP2010260204A Machine Translation (by EPO and Google)—published Nov. 18, 2010; Canon KK.
JP2010260287 Machine Translation (by EPO and Google)—published Nov. 18, 2010, Canon KK.
JP2010260302A Machine Translation (by EPO and Google)—published Nov. 18, 2010; Riso Kagaku Corp.
JP2011002532 Machine Translation (by PlatPat English machine translation)—published Jan. 6, 2011 Seiko Epson Corp.
JP2011025431 Machine Translation (by EPO and Google)—published Feb. 10, 2011; Fuji Xerox Co Ltd.
JP2011031619A Machine Translation (by EPO and Google)—published Feb. 17, 2011; Xerox Corp.
JP2011037070A Machine Translation (by EPO and Google)—published Feb. 24, 2011; Riso Kagaku Corp.
JP2011067956A Machine Translation (by EPO and Google)—published Apr. 7, 2011; Fuji Xerox Co Ltd.
JP2011126031A Machine Translation (by EPO and Google); published on Jun. 30, 2011, Kao Corp.
JP2011144271 Machine Translation (by EPO and Google)—published Jun. 28, 2011 Toyo Ink SC Holdings Co Ltd.
JP2011173325 Abstract; Machine Translation (by EPO and Google)—published Sep. 8, 2011; Canon Inc.
JP2011173326 Machine Translation (by EPO and Google)—published Sep. 8, 2011; Canon Inc.
JP2011186346 Machine Translation (by PlatPat English machine translation)—published Sep. 22, 2011 Seiko Epson Corp, Nishimura et al.
JP2011189627 Machine Translation (by Google Patents)—published Sep. 29, 2011; Canon KK.
JP2011201951A Machine Translation (by PlatPat English machine translation); published on Oct. 13, 2011, Shin-Etsu Chemical Co Ltd, Todoroki et al.
JP2011224032 Machine Translation (by EPO & Google)—published Nov. 10, 2011, Mameita KK.
JP2012086499 Machine Translation (by EPO and Google)—published May 10, 2012; Canon Inc.
JP2012111194 Machine Translation (by EPO and Google)—published Jun. 14, 2012; Konica Minolta.
JP2012196787A Machine Translation (by EPO and Google)—published Oct. 18, 2012; Seiko Epson Corp.
JP2012201419A Machine Translation (by EPO and Google)—published Oct. 22, 2012, Seiko Epson Corp.
JP2013001081 Machine Translation (by EPO and Google)—published Jan. 7, 2013; Kao Corp.
JP2013060299 Machine Translation (by EPO and Google)—published Apr. 4, 2013; Ricoh Co Ltd.
JP2013103474 Machine Translation (by EPO and Google)—published May 30, 2013; Ricoh Co Ltd.
JP2013121671 Machine Translation (by EPO and Google)—published Jun. 20, 2013; Fuji Xerox Co Ltd.
JP2013129158 Machine Translation (by EPO and Google)—published Jul. 4, 2013; Fuji Xerox Co Ltd.
JP2014047005A Machine Translation (by EPO and Google)—published Mar. 17, 2014; Ricoh Co Ltd.
JP2014094827A Machine Translation (by EPO and Google)—published May 22, 2014; Panasonic Corp.
JP2014131843A Machine Translation (by EPO and Google)—published Jul. 17, 2014; Ricoh Co Ltd.
JP2016093999A Machine Translation (by EPO and Google)—published May 26, 2016; Canon KK.
JP2016185688A Machine Translation (by EPO and Google)—published Oct. 27, 2016; Hitachi Industry Equipment Systems Co Ltd.
JP2529651B2 Machine Translation (by EPO and Google)—issued Aug. 28, 1996;Osaka Sealing Insatsu KK.
JPH03248170A Machine Translation (by EPO & Google)—published Nov. 6, 1991; Fujitsu Ltd.
JPH05147208 Machine Translation (by EPO and Google)—published Jun. 15, 1993—Mita Industrial Co Ltd.
JPH06100807 Machine Translation (by EPO and Google)—published Apr. 12, 1994; Seiko Instr Inc.
JPH06171076A Machine Translation (by PlatPat English machine translation)—published Jun. 21, 1994, Seiko Epson Corp.
JPH06345284A Machine Translation (by EPO and Google); published on Dec. 20, 1994, Seiko Epson Corp.
JPH06954A Machine Translation (by EPO and Google)—published Jan. 11, 1994; Seiko Epson Corp.
JPH07186453A Machine Translation (by EPO and Google)—published Jul. 25, 1995; Toshiba Corp.
JPH07238243A Machine Translation (by EPO and Google)—published Sep. 12, 1995; Seiko Instr Inc.
JPH08112970 Machine Translation (by EPO and Google)—published May 7, 1996; Fuji Photo Film Co Ltd.
JPH0862999A Machine Translation (by EPO & Google)—published Mar. 8, 1996 Toray Industries, Yoshida, Tomoyuki.
JPH09123432 Machine Translation (by EPO and Google)—published May 13, 1997, Mita Industrial Co Ltd.
JPH09157559A Machine Translation (by EPO and Google)—published Jun. 17, 1997; Toyo Ink Mfg Co.
JPH09281851A Machine Translation (by EPO and Google)—published Oct. 31, 1997; Seiko Epson Corp.
JPH09300678A Machine Translation (by EPO and Google)—published Nov. 25, 1997; Mitsubishi Electric Corp.
JPH09314867A Machine Translation (by PlatPat English machine translation)—published Dec. 9, 1997, Toshiba Corp.
JPH11106081A Machine Translation (by EPO and Google)—published Apr. 20, 1999; Ricoh KK.
JPH11138740A Machine Translation (by EPO and Google)—published May 25, 1999; Nikka KK.
JPH11245383A Machine Translation (by EPO and Google)—published Sep. 14, 1999; Xerox Corp.
JPH5297737 Machine Translation (by EPO & Google machine translation)—published Nov. 12, 1993 Fuji Xerox Co Ltd.
JPS5578904A Machine Translation (by EPO and Google)—published Jun. 14, 1980; Yokoyama Haruo.
JPS57121446U Machine Translation (by EPO and Google)—published Jul. 28, 1982.
JPS60199692A Machine Translation (by EPO and Google)—published Oct. 9, 1985; Suwa Seikosha KK.
JPS6076343A Machine Translation (by EPO and Google)—published Apr. 30, 1985; Toray Industries.
JPS6223783A Machine Translation (by EPO and Google)—published Jan. 31, 1987; Canon KK.

(56) References Cited

OTHER PUBLICATIONS

Larostat 264 a Quaternary Ammonium Compound, Technical Bulletin, BASF Corporation, Dec. 2002, p. 1.
Machine Translation (by EPO and Google) of JPH07112841 published on May 2, 1995 Canon KK.
Marconi Studios, Virtual SET Real Time; http://www.marconistudios.il/pages/virtualset_en.php.
Montuori G.M., et al., "Geometrical Patterns for Diagrid Buildings: Exploring Alternative Design Strategies From the Structural Point of View," Engineering Structures, Jul. 2014, vol. 71, pp. 112-127.
"Solubility of Alcohol", in http://www.solubilityoflhings.com/water/alcohol; downloaded on Nov. 30, 2017.
Poly(vinyl acetate) data sheet. PolymerProcessing.com. Copyright 2010. http://polymerprocessing .com/polymers/PV AC.html.
Royal Television Society, The Flight of the Phoenix; https://rts.org.uk/article/flight-phoenix, Jan. 27, 2011.
RU2180675C2 Machine Translation (by EPO and Google)—published Mar. 20, 2002; Zao Rezinotekhnika.
RU2282643C1 Machine Translation (by EPO and Google)—published Aug. 27, 2006; Balakovorezinotekhnika Aoot.
Technical Information Lupasol Types, Sep. 2010, 10 pages.
The Engineering Toolbox., "Dynamic Viscosity of Common Liquids," 2018, 4 pages.
Units of Viscosity published by Hydramotion Ltd. 1 York Road Park, Malton, York Y017 6YA, England; downloaded from www.hydramotion.com website on Jun. 19, 2017.
WO2006051733A1 Machine Translation (by EPO and Google)—published May 18, 2006; Konica Minolta Med & Graphic.
WO2010073916A1 Machine Translation (by EPO and Google)—published Jul. 1, 2010; Nihon Parkerizing [JP] et al.
WO2013087249 Machine Translation (by EPO and Google)—published Jun. 20, 2013; Koenig & Bauer AG.

* cited by examiner

FRICTION REDUCTION MEANS FOR PRINTING SYSTEMS AND METHOD

FIELD OF THE INVENTION

The present disclosure relates to an intermediate transfer member (ITM) used in a printing system in which liquid ink droplets are deposited at an image forming station onto a movable ITM and transferred at an impression station from the ITM onto a printing substrate. Specifically, this disclosure pertains to a system and a method for reducing friction between the ITM and a guiding arrangement through which the ITM is guided along the printing system between the image forming station and the impression station.

SUMMARY OF THE INVENTION

The invention, in some embodiments, relates to a friction reduction system for reducing friction of an ITM of a printing system, while the ITM is guided along the printing system by a guiding arrangement.

The invention, in some embodiments, relates to a printing system including a friction reduction system for reducing friction between the ITM of the printing system and the guiding arrangement through which the ITM is guided.

The invention, in some embodiments, relates to a method for reducing friction between an ITM in a printing system and a guiding arrangement through which the ITM is guided along the printing system As is discussed in greater detail hereinbelow, a friction reduction system according to the present invention includes a fluid reservoir, and a fluid depositing arrangement. Fluid is deposited from the fluid depositing arrangement onto the guiding arrangement or onto the ITM, typically at an area of contact therebetween, thereby to reduce the friction between the ITM and the guiding arrangement. The depositing of fluid by the fluid depositing arrangement is controlled by a control mechanism, such that fluid is deposited periodically, continuously, and/or intermittently.

There is thus provided, in accordance with an embodiment of a first aspect of the invention, a friction reduction system for reducing friction between an intermediate transfer member (ITM) of a printing system and a guiding arrangement of the printing system, while the ITM is guided along the printing system by the guiding arrangement, the friction reduction system including:

- a fluid reservoir mounted within the printing system;
- a fluid depositing arrangement disposed at at least one position along the ITM; and
- a control mechanism, adapted to control depositing of fluid, from the fluid depositing arrangement onto the guiding arrangement or onto at least a portion of the ITM, wherein depositing of the fluid reduces friction between the ITM and the guiding arrangement.

In some embodiments, the control mechanism is adapted to control deposition of fluid from the fluid depositing arrangement onto the ITM at a contact area between the ITM and the guiding arrangement.

In some embodiments, the fluid depositing arrangement includes at least one fluid depositing nozzle.

In some embodiments, the guiding arrangement includes a pair of guiding tracks, such that lateral ends of the ITM are disposed within the guiding tracks and are guided thereal-ong.

In some embodiments, the control mechanism is adapted to control the fluid depositing arrangement such that the fluid is continuously deposited onto the guiding arrangement or onto the at least a portion of the ITM. In some embodiments, the control mechanism is adapted to control the fluid depositing arrangement such that the fluid is continuously deposited at a fixed continuous fluid deposition rate. In some embodiments, the fixed continuous fluid deposition rate is in the range of 1 ml to 50 ml, per hour.

In some embodiments, the control mechanism is adapted to control the fluid depositing arrangement such that fluid is periodically deposited from the fluid depositing arrangement onto the guiding arrangement or onto the at least a portion of the ITM. In some embodiments, the control mechanism is adapted to control the fluid depositing arrangement such that a fixed volume of the fluid is deposited at least every 5 minutes, at least every 10 minutes, at least every 15 minutes, at least every 30 minutes, or at least every 45 minutes. In some embodiments, the fixed volume is in the range of 1 ml to 50 ml.

In some embodiments, the control mechanism is adapted to control the fluid depositing arrangement such that fluid is intermittently deposited from the fluid depositing arrangement onto the guiding arrangement or onto the at least a portion of the ITM.

In some embodiments, the control mechanism is adapted to control the fluid depositing arrangement to deposit fluid in response to the identification of an increase in friction between the ITM and the guiding arrangement. In some embodiments, the control mechanism is adapted to identify an increase in electrical current in the printing system, thereby to identify the increase in friction.

In some embodiments, the control mechanism is adapted to control the fluid depositing arrangement to deposit fluid in response to the identification of an increase in temperature of the ITM or of the guiding arrangement at a region of interface between the ITM and the guiding arrangement.

In some embodiments, the control mechanism is functionally associated with a user interface, and is adapted to control the fluid depositing arrangement to deposit fluid in response to receipt of a corresponding user instruction.

In some embodiments, the fluid depositing arrangement includes a plurality of pre-defined fluid depositing locations at which fluid can be deposited onto the guiding arrangement or onto the at least a portion of the ITM, and wherein the control mechanism is adapted to control the fluid depositing arrangement such that fluid is deposited at a specific one of the plurality of pre-defined fluid depositing locations.

In some embodiments, the fluid deposited onto the guiding arrangement or onto the at least a portion of the ITM is adapted to reduce friction by reducing at least a local temperature of at least a portion of the ITM or of at least a portion of the guiding arrangement, at a region of engagement between the ITM and the guiding arrangement. In some embodiments, the fluid is water. In some embodiments, the fluid is pressurized air.

In some embodiments, the fluid deposited onto the guiding arrangement or onto the at least a portion of the ITM is adapted to reduce friction by lubricating a contact area of the ITM and the guiding arrangement.

In some embodiments, the fluid includes an aqueous emulsion. In some embodiments, the emulsion includes at least 70% water, at least 75% water, at least 80% water, at least 85% water, at least 90% water, or at least 95% water. In some embodiments, the emulsion includes at most 30% lubricant, at most 25% lubricant, at most 20% lubricant, at most 15% lubricant, at most 10% lubricant, or at most 5% lubricant. In some embodiments, the emulsion includes 80% water and 10% lubricant.

In some embodiments, the lubricant includes pure silicone.

In some embodiments, the lubricant does not detrimentally affect printing quality or characteristics of the ITM.

In some embodiments, the ITM includes a seam, and, under fixed testing conditions, a force at which seam failure occurs, following deposition onto the ITM of the lubricant at a rate of 10 cc of fluid per hour for a duration of 72 hours, is smaller than a force at which seam failure occurs prior to deposition of the lubricant, by at most 30%, at most 25%, at most 20%, at most 15%, at most 10%, or at most 5%.

In some embodiments, the ITM includes a pair of laterally extending guiding formations along lateral edges of the ITM, which guiding formations extend through the guiding arrangement. In some embodiments, under fixed testing conditions, a peeling force at which failure occurs between the guiding formations and the lateral edges of the ITM, following deposition onto the ITM of the lubricant at a rate of 10 cc per hour for a duration of 72 hours, is smaller than a peeling force at which such failure occurred prior to deposition of the lubricant by at most 35%, at most 30%, at most 25%, at most 20%, at most 15%, at most 10%, or at most 5%.

In some embodiments, under fixed testing conditions, a spring constant of the guiding formations measured following deposition onto the ITM of the lubricant at a rate of 10 cc per hour for a duration of 72 hours, differs from a spring constant of the guiding formations measured prior to deposition of the lubricant by at most 15%, at most 10%, or at most 5%.

In some embodiments, the lubricant is further adapted to clean the guiding arrangement.

In some embodiments, the lubricant is chemically stable at a temperature at which the fluid is stored in the printing system. In some embodiments, the lubricant is chemically stable at least at a temperature in the range of 5 to 40 degrees Celsius.

In some embodiments, the fluid depositing arrangement includes a first fluid depositing nozzle disposed at a first location on a first side of the guiding arrangement, and a second fluid depositing nozzle disposed above a second location on a second side of the guiding arrangement, the first and second fluid depositing nozzles being functionally associated with the control mechanism. In some embodiments, the second location is substantially parallel to the first location.

In some embodiments, the friction reduction system further includes a pumping arrangement, in fluid flow communication with the fluid reservoir and the fluid depositing arrangement, the pumping arrangement adapted to pump fluid from the reservoir to the fluid depositing arrangement.

There is further provided, in accordance with an embodiment of a second aspect of the invention, a printing system including:

- an intermediate transfer member (ITM) formed as an endless belt;
- an image forming station at which droplets of an ink are applied to an outer surface of the ITM to form an ink image;
- a drying station for drying the ink image to leave an ink residue film;
- an impression station at which the residue film is transferred to a substrate;
- a guiding arrangement, having lateral edges of the ITM guided therealong for guiding the ITM from the image forming station, via the drying station, to the impression station; and
- a friction reduction system for reducing friction between the ITM and the guiding arrangement while the ITM is guided along the guiding arrangement, the friction reduction system including:
  - a fluid reservoir mounted within the printing system;
  - a fluid depositing arrangement, disposed at at least one position along the ITM; and
  - a control mechanism, adapted to control depositing of fluid, from the fluid depositing arrangement onto the guiding arrangement or onto at least a portion of the ITM.

In some embodiments, the control mechanism is adapted to control deposition of fluid from the fluid depositing arrangement onto the ITM at a contact area between the ITM and the guiding arrangement.

In some embodiments, the fluid depositing arrangement includes at least one fluid depositing nozzle.

In some embodiments, the guiding arrangement includes a pair of guiding tracks, such that lateral ends of the ITM are disposed within the guiding tracks and are guided therealong.

In some embodiments, the control mechanism is adapted to control the fluid depositing arrangement such that the fluid is continuously deposited onto the guiding arrangement or onto the at least a portion of the ITM. In some embodiments, the control mechanism is adapted to control the fluid depositing arrangement such that the fluid is continuously deposited at a fixed continuous fluid deposition rate. In some embodiments, the fixed continuous fluid deposition rate is in the range of 1 ml to 50 ml, per hour.

In some embodiments, the control mechanism is adapted to control the fluid depositing arrangement such that fluid is periodically deposited from the fluid depositing arrangement onto the guiding arrangement or onto the at least a portion of the ITM. In some embodiments, the control mechanism is adapted to control the fluid depositing arrangement such that a fixed volume of the fluid is deposited at least every 5 minutes, at least every 10 minutes, at least every 15 minutes, at least every 30 minutes, or at least every 45 minutes. In some embodiments, the fixed volume is in the range of 1 ml to 50 ml.

In some embodiments, the control mechanism is adapted to control the fluid depositing arrangement such that fluid is intermittently deposited from the fluid depositing arrangement onto the guiding arrangement or onto the at least a portion of the ITM.

In some embodiments, the control mechanism is adapted to control the fluid depositing arrangement to deposit fluid in response to the identification of an increase in friction between the ITM and the guiding arrangement. In some embodiments, the control mechanism is adapted to identify an increase in electrical current in the printing system, thereby to identify the increase in friction.

In some embodiments, the control mechanism is adapted to control the fluid depositing arrangement to deposit fluid in response to the identification of an increase in temperature of the ITM or of the guiding arrangement at a region of interface between the ITM and the guiding arrangement.

In some embodiments, the control mechanism is functionally associated with a user interface, and is adapted to control the fluid depositing arrangement to deposit fluid in response to receipt of a corresponding user instruction.

In some embodiments, the fluid depositing arrangement includes a plurality of pre-defined fluid depositing locations at which fluid can be deposited onto the guiding arrangement or onto the at least a portion of the ITM, and wherein the control mechanism is adapted to control the fluid depositing arrangement such that fluid is deposited at a specific one of the plurality of pre-defined fluid depositing locations.

In some embodiments, the fluid deposited onto the guiding arrangement or onto the at least a portion of the ITM is adapted to reduce friction by reducing at least a local temperature of at least a portion of the ITM or of at least a portion of the guiding arrangement at a region of engagement between the ITM and the guiding arrangement. In some embodiments, the fluid is water. In some embodiments, the fluid is pressurized air.

In some embodiments, the fluid deposited onto the guiding arrangement or onto the at least a portion of the ITM is adapted to reduce friction by lubricating a contact area of the ITM and the guiding arrangement.

In some embodiments, the fluid includes an aqueous emulsion. In some embodiments, the emulsion includes at least 70% water, at least 75% water, at least 80% water, at least 85% water, at least 90% water, or at least 95% water. In some embodiments, the emulsion includes at most 30% lubricant, at most 25% lubricant, at most 20% lubricant, at most 15% lubricant, at most 10% lubricant, or at most 5% lubricant. In some embodiments, the emulsion includes 80% water and 10% lubricant. In some embodiments, the lubricant includes pure silicone.

In some embodiments, the lubricant does not detrimentally affect printing quality or characteristics of the ITM.

In some embodiments, the ITM includes a seam, and, under fixed testing conditions, a force at which seam failure occurs, following deposition onto the ITM of the lubricant at a rate of 10 cc of fluid per hour for a duration of 72 hours, is smaller than a force at which seam failure occurs prior to deposition of the lubricant, by at most 30%, at most 25%, at most 20%, at most 15%, at most 10%, or at most 5%.

In some embodiments, the ITM includes a pair of laterally extending guiding formations along lateral edges of the ITM, which guiding formations extend through the guiding arrangement.

In some embodiments, under fixed testing conditions, a peeling force at which failure occurs between the guiding formations and the lateral edges of the ITM, following deposition onto the ITM of the lubricant at a rate of 10 cc per hour for a duration of 72 hours, is smaller than a peeling force at which such failure occurred prior to deposition of the lubricant by at most 35%, at most 30%, at most 25%, at most 20%, at most 15%, at most 10%, or at most 5%.

In some embodiments, under fixed testing conditions, a spring constant of the guiding formations measured following deposition onto the ITM of the lubricant at a rate of 10 cc per hour for a duration of 72 hours, differs from a spring constant of the guiding formations measured prior to deposition of the lubricant by at most 15%, at most 10%, or at most 5%.

In some embodiments, the lubricant is further adapted to clean the guiding arrangement.

In some embodiments, the lubricant is chemically stable at a temperature at which the fluid is stored in the printing system. In some embodiments, the lubricant is chemically stable at least at a temperature in the range of 5 to 40 degrees Celsius.

In some embodiments, the fluid depositing arrangement includes a first fluid depositing nozzle disposed at a first location on a first side of the guiding arrangement, and a second fluid depositing nozzle disposed at a second location on a second side of the guiding arrangement, the first and second fluid depositing nozzles being functionally associated with the control mechanism. In some embodiments, the second location is substantially parallel to the first location.

In some embodiments, the fluid depositing arrangement is disposed adjacent the image forming station.

In some embodiments, the friction reduction system further includes a pumping arrangement, in fluid flow communication with the fluid reservoir and the fluid depositing arrangement, the pumping arrangement adapted to pump fluid from the reservoir to the fluid depositing arrangement.

There is further provided, in accordance with an embodiment of a third aspect of the invention, a method of reducing friction between an intermediate transfer member (ITM) of a printing system and a guiding arrangement through which the ITM is guided along the printing system, the method including:

depositing a fluid from a fluid deposition system, onto the guiding arrangement or onto at least a portion of the ITM, at or adjacent a contact area between the guiding arrangement and the ITM, thereby to reduce friction between the ITM and the guiding arrangement.

In some embodiments, the depositing includes continuously depositing the fluid. In some embodiments, the continuously depositing includes continuously depositing the fluid at a fixed continuous fluid deposition rate. In some embodiments, the fixed continuous fluid deposition rate is in the range of 1 ml to 50 ml, per hour.

In some embodiments, depositing includes periodically depositing the fluid. In some embodiments, the periodically depositing includes depositing a fixed volume of the fluid at least every 5 minutes, at least every 10 minutes, at least every 15 minutes, at least every 30 minutes, or at least every 45 minutes. In some embodiments, the fixed volume is in the range of 1 ml to 50 ml.

In some embodiments, the depositing includes intermittently depositing the fluid.

In some embodiments, intermittently depositing includes identifying an increase in friction between the ITM and the guiding arrangement and depositing a volume of the fluid in response to the identifying the increase in friction. In some embodiments, the identifying the increase in friction includes identifying an increase in electrical current in the printing system.

In some embodiments, the intermittently depositing includes identifying at least a local increase in temperature of the ITM or of the guiding arrangement at the contact area and depositing a volume of the fluid in response to the identifying the increase in temperature.

In some embodiments, the volume is in the range of 1 ml to 50 ml.

In some embodiments, intermittently depositing includes receiving, via a user interface of the printing system, a user instruction, and depositing a volume of the fluid in response to the receiving the user instruction.

In some embodiments, the fluid depositing arrangement includes a plurality of pre-defined fluid depositing locations at which fluid can be deposited onto the guiding arrangement or onto the at least a portion of the ITM, and wherein the depositing the fluid includes controlling the fluid depositing arrangement to deposit the fluid at a specific one of the plurality of pre-defined fluid depositing locations.

In some embodiments, the depositing the fluid includes reducing at least a local temperature of at least a portion of the ITM or of at least a portion of the guiding arrangement at the contact area. In some embodiments, the fluid is water. In some embodiments, the fluid is pressurized air.

In some embodiments, the depositing the fluid includes lubricating a contact area of the ITM and the guiding arrangement.

In some embodiments, the fluid includes an aqueous emulsion. In some embodiments, the emulsion includes at least 70% water, at least 75% water, at least 80% water, at least 85% water, at least 90% water, or at least 95% water. In some embodiments, the emulsion includes at most 30% lubricant, at most 25% lubricant, at most 20% lubricant, at most 15% lubricant, at most 10% lubricant, or at most 5% lubricant. In some embodiments, the emulsion includes 80% water and 10% lubricant. In some embodiments, the lubricant includes pure silicone.

In some embodiments, the depositing the fluid further includes cleaning the guiding arrangement.

In some embodiments, the lubricant is chemically stable at a temperature at which the fluid is stored in the printing system. In some embodiments, the lubricant is chemically stable at least at a temperature in the range of 5 to 40 degrees Celsius.

There is further provided, in accordance with an embodiment of a fourth aspect of the invention, a method of printing an image onto a substrate in a printing system including an intermediate transfer member (ITM) guided by a guiding arrangement between a printing station and an impression station, the method including:

- inkjet printing an image onto a surface of the ITM;
- rotating the ITM to move the image from the printing station to the impression station;
- transferring the image from the surface of the ITM onto the substrate; and
- during at least one of the printing, the rotating, and the transferring, reducing friction between the ITM and the guiding arrangement according to the method described herein.

BRIEF DESCRIPTION OF THE DRAWINGS

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures are not to scale.

In the Figures.

DESCRIPTION OF SOME EMBODIMENTS OF THE INVENTION

Figure 1:
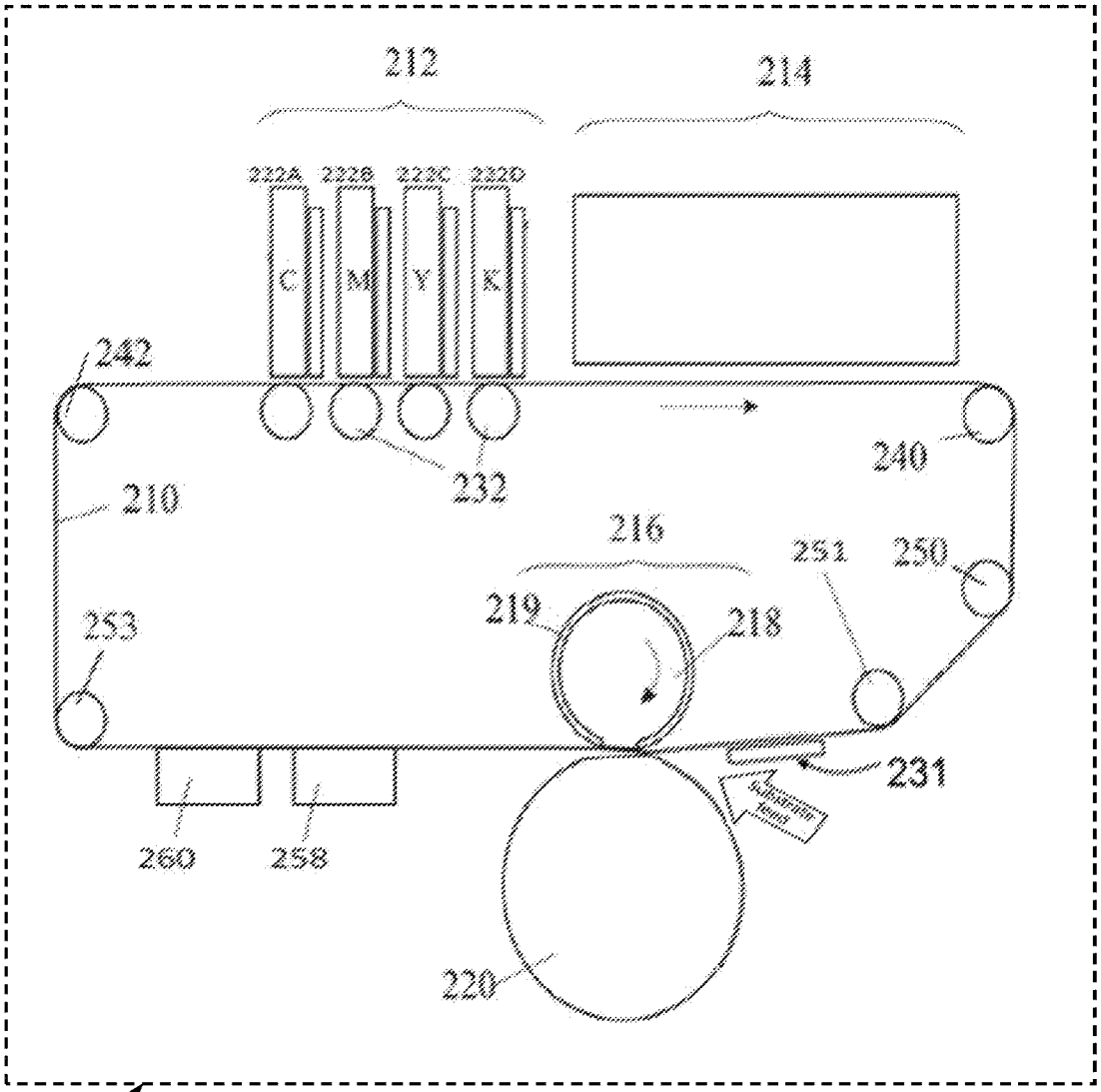
FIG. 1 is a schematic illustration of a printing system.

The invention, in some embodiments, relates to a friction reduction system for reducing friction of an ITM of a printing system, while the ITM is guided along the printing system by a guiding arrangement.

The invention, in some embodiments, relates to a printing system including a friction reduction system for reducing friction between the ITM of the printing system and the guiding arrangement through which the ITM is guided.

The invention, in some embodiments, relates to a method for reducing friction between an ITM in a printing system and a guiding arrangement through which the ITM is guided along the printing system In many currently used printing systems, the ITM is guided through a guiding arrangement. While the system is printing, the temperature of the ITM increases, and thus the friction between the ITM and the guiding arrangement also increases, which in turn results in a further increase in temperature. The increase in temperature and friction between the ITM and guiding arrangement may put excessive strain on the printing system, and in some cases may also impact the quality of image transfer from the ITM to the substrate, and as a result the quality of printing.

The present invention solves the deficiencies of the prior art by providing friction reducing system which reduces the friction between the ITM and the guiding arrangement while the printing system is working, without adversely affecting the image release or the quality of printing.

The principles, uses and implementations of the teachings herein may be better understood with reference to the accompanying description and figures. Upon perusal of the description and figures present herein, one skilled in the art is able to implement the invention without undue effort or experimentation. In the figures, like reference numerals refer to like parts throughout.

Before explaining at least one embodiment in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purposes and should not be regarded as limiting.

Additional objects, features and advantages of the invention will be set forth in the detailed description which follows, and in part will be readily apparent to those skilled in the art from the description or recognized by practicing the invention as described in the written description and claims hereof, as well as the appended drawings. Various features and sub-combinations of embodiments of the invention may be employed without reference to other features and subcombinations.

It is to be understood that both the foregoing general description and the following detailed description, including the materials, methods and examples, are merely exemplary of the invention, and are intended to provide an overview or framework to understanding the nature and character of the invention as it is claimed, and are not intended to be necessarily limiting.

In the context of the description and claims herein, the terms "seam", "belt seam", and "blanket seam" may be used interchangeably and relate to a material or substance used to connect first and second free ends of an elongate belt to one another, thereby to form a continuous loop, or endless belt, usable as an ITM.

In the context of the description and claims herein, the terms "blanket" and "belt" are used interchangeably and relate to a surface suitable for use as a printing surface in a printing system, such as for use as an ITM.

In the context of the description and claims herein, the term "periodically" relates to an action that is carried out at regular intervals, or substantially regular intervals, such as, for example, once every 10 minutes, once every 30 minutes, once every hour, once every 3 hours, once every six hours, once every 12 hours, once every day, once every week, or once every month.

In the context of the description and claims herein, the term "intermittently" relates to an action that is carried out at various times, without there being any well-defined or regular duration between any two adjacent occurrences of the action.

In the context of the description and claims herein, the term "chemically stable" relates to a material that, under the specified conditions, is thermodynamically stable without phase separation and without carrying out side chemical reaction with other substances in its environment.

In the context of the description and claims herein, the term "substantially" relates to a deviation of up to 10%, up to 8%, or up to 5% from the specified value or arrangement.

Reference is now made to FIG. 1, which is a schematic illustration of a printing system 10 that implements an indirect printing process.

The system 10 comprises an ITM (ITM) 210 comprising a flexible endless belt mounted over a plurality of guide rollers 232, 240, 250, 251, 253, and 242.

In the specification herein, the ITM may be referred to also as an elongate belt having ends connected by a seam, as an endless belt, or as a continuous loop belt.

In some embodiments, the belt of ITM 210 has a length of up to 20 meters, and typically, a length within a range of 5-20, 5-15, 5-12, or 7-12 meters. In some embodiments, the belt of ITM 210 has a width of up to 2.0 meters, and typically, within a range of 0.3-2.0, 0.75-2.0, 0.75-1.5, or 0.75-1.25 meters.

In some embodiments, the belt of ITM 210 has a thickness of up to 3000 μm, and typically, within a range of 200-3000, 200-1500, 300-1000, 300-800, 300-700, 100-3000, 50-3000, or 100-600 μm.

In the example of FIG. 1, the ITM 210 (i.e. belt thereof) moves in the clockwise direction. The direction of belt movement defines upstream and downstream directions. Rollers 242, 240 are respectively positioned upstream and downstream of an image forming station 212—thus, roller 242 may be referred to as a "upstream roller" while roller 240 may be referred to as a "downstream roller".

The system of FIG. 1 further includes:

(a) an image forming station 212 (e.g. comprising print bars 222A-222D, where each print bar comprises ink jet head(s)) configured to form ink images (not shown) upon a surface of the ITM 210 (e.g. by droplet deposition upon a dried treatment film).

(b) a drying station 214 for drying the ink images.

(c) an impression station 216 where the ink images are transferred from the surface of the ITM 210 to sheet or web substrate. In the particular non-limiting example of FIG. 1, impression station 216 comprises an impression cylinder 220 and a blanket cylinder 218 that carries a compressible blanket or belt 219. In some embodiments, a heater 231 may be provided shortly prior to the nip between the two cylinders 218 and 220 of the image transfer station to assist in rendering the ink film tacky, so as to facilitate transfer to the substrate (e.g. sheet substrate or web substrate). The substrate feed is illustrated schematically.

(d) a cleaning station 258 where the surface of the ITM 210 is cleaned.

(e) a treatment station 260 (i.e. in FIG. 1 illustrated schematically as a block) where a layer (e.g. of uniform thickness) of liquid treatment formulation (e.g. aqueous treatment formulation) on the ITM surface can be formed.

The skilled artisan will appreciate that not every component illustrated in FIG. 1 is required.

Exemplary descriptions of printing systems are disclosed in Applicant's PCT Publications No. WO 2013/132418 and No. WO 2017/208152.

The primary purpose of the belt is to receive an ink image from the inkjet heads and to transfer that image dried but undisturbed to the substrate at the impression stations 216. Though not illustrated in the Figures, the belt forming the ITM may have multiple layers to impart desired properties to the transfer member. Specifically, the belt may include a release layer, which is an outer layer of the receiving the ink image and having suitable release properties.

Non-limiting examples of release layers and ITMs are disclosed in the Applicant's PCT Publications No. WO 2013/132432, No. WO 2013/132438 and No. WO 2017/208144.

In some printing systems, the ITM may be optionally treated at the treatment station 260 to further increase the interaction of the compatible ink with the ITM, or further facilitate the release of the dried ink image to the substrate, or provide for a desired printing effect.

Exemplary description of the treatment fluid is disclosed in Applicant's PCT Application Publication No. WO 2017/208246.

Though not shown in the figures, the substrate may be a continuous web, in which case the input and output stacks are replaced by a supply roller and a delivery roller. The substrate transport system needs to be adapted accordingly, for instance by using guide rollers and dancers taking slacks of web to properly align it with the impression station.

In the non-limiting example of FIG. 1 the printing system cannot achieve duplex printing but it is possible to provide a perfecting system to reverse substrate sheets and pass them a second time through the same nip. As a further alternative, the printing system may comprise a second impression station for transferring an ink image to opposite sides of the substrates.

Figure 2B:
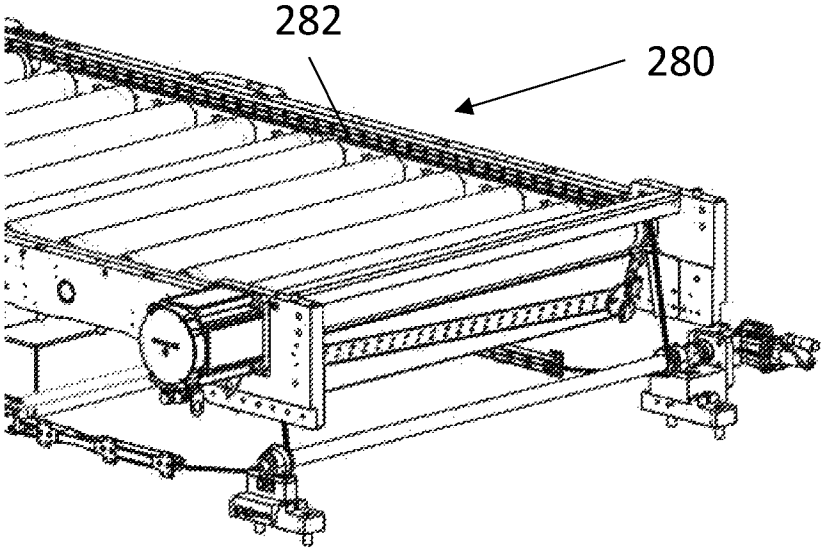
FIGS. 2A and 2B are, respectively, a top view planar illustration of an exemplary portion of an ITM and a perspective illustration of a corresponding exemplary guiding arrangement, which may form part of the printing system of FIG. 1.
Figure 2A:
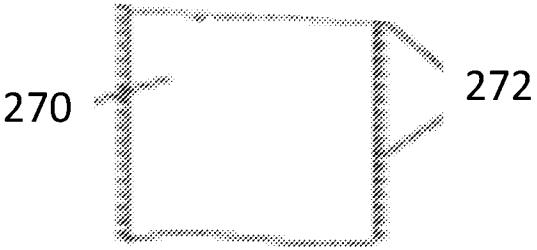

Reference is now made to FIG. 2A, which shows a portion of a belt 270, suitable for forming an ITM such as ITM 210 of FIG. 1, having lateral formations 272 formed on lateral sides thereof. Lateral formations 272 may be used for threading belt 270 through a printing system, such as printing system 10 (FIG. 1) to form an endless belt of an ITM, such as ITM 210 (FIG. 1), and for guiding the ITM through corresponding lateral channels of a guiding arrangement along the printing system during the printing process.

The lateral formations 272 may be spaced projections, such as the teeth of one half of a zip fastener sewn or otherwise attached to each side edge of the belt 270, as shown in the embodiment of FIG. 2A. Such lateral formations need not be regularly spaced.

Alternatively, the formations may be a continuous flexible bead of greater thickness than the belt 270. The lateral formations 272 may be directly attached to the edges of the belt 270 or ay be attached through an intermediate strip that can optionally provide suitable elasticity to engage the formations in corresponding lateral channels of a guiding arrangement, described and illustrated hereinbelow with reference to FIG. 2B, while maintaining the ITM 210 flat, in particular at the image forming station 212 (FIG. 1) of the printing system.

The lateral formations 272 may be made of any material able to sustain the operating conditions of the printing system, including the rapid motion of the ITM. Suitable materials can resist elevated temperatures in the range of about 50° C. to 250° C. Advantageously, such materials do not yield debris of size and/or amount that would negatively affect the movement of the belt during its operative lifespan. For example, the lateral formations 272 can be made of polyamide reinforced with molybdenum disulfide.

Further details on exemplary belt lateral formations according to the present invention are disclosed in PCT Publications Nos. WO 2013/136220 and WO 2013/132418.

Reference is now made to FIG. 2B, which is a perspective view of an exemplary guiding arrangement 280, which may form part of a printing system, such as printing system 10 of FIG. 1.

The guiding arrangement 280 comprises a pair of continuous lateral tracks, each defining a guiding channel 282 that can engage lateral formations 272 on one of the lateral edges of the belt, as illustrated in FIG. 2A, to maintain the belt taut in its width ways direction during threading and use thereof. The guiding channel 282 may have any cross-section suitable to receive and retain the belt lateral formations 272 and maintain the belt taut.

Further details on exemplary belt lateral formations and on guide channels suitable for receiving such lateral formations, are disclosed in PCT Publication Nos. WO 2013/136220 and WO 2013/132418.

Figure 3:
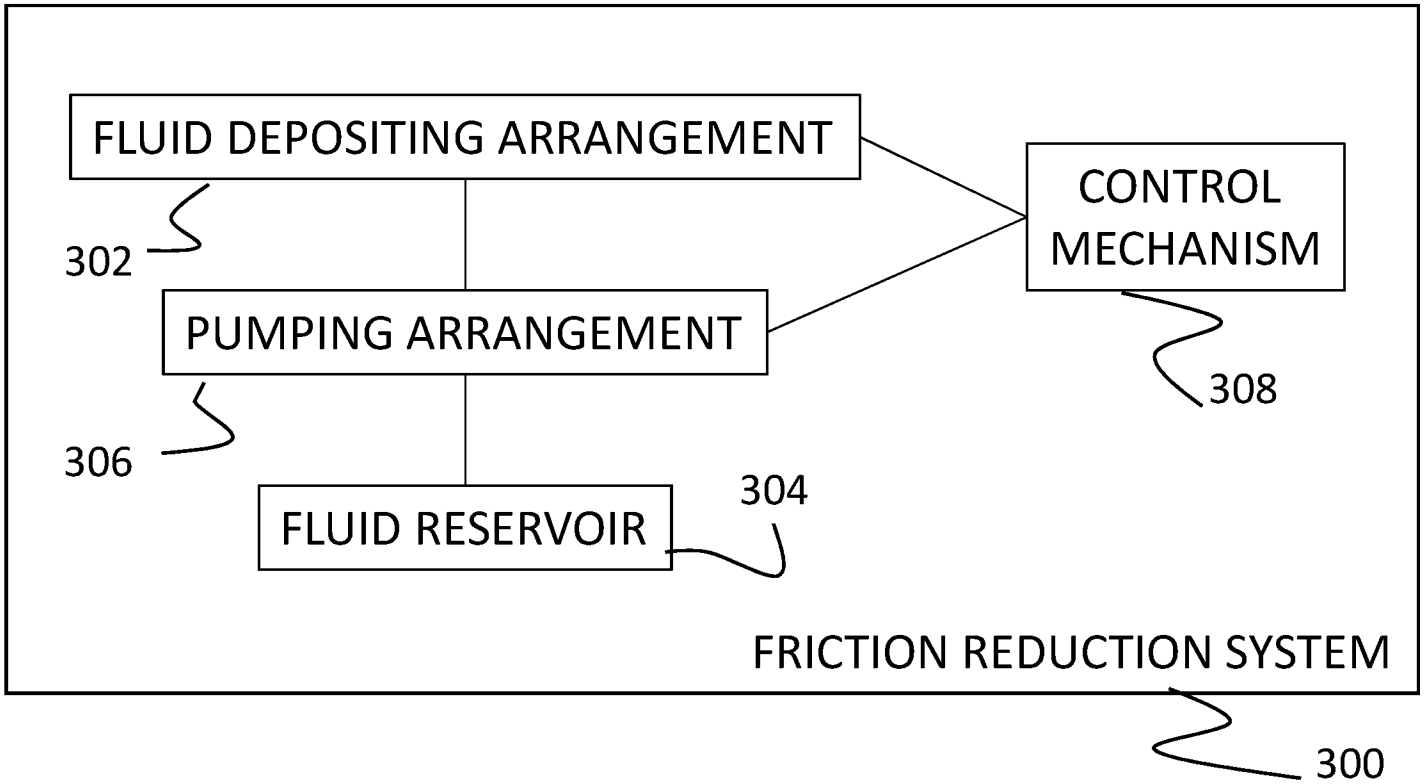
FIG. 3 is a schematic block diagram of a friction reduction system in accordance with an embodiment of the present invention.

Reference is now made to FIG. 3, which is a schematic block diagram of a friction reduction system 300, usable in a printing system such as printing system 10 of FIG. 1, in accordance with an embodiment of the present invention.

The friction reduction system 300 includes a fluid depositing arrangement 302, in fluid flow communication with a fluid reservoir 304, which is mounted at any suitable location within printing system 10. As described in further detail hereinbelow with respect to FIG. 4, the fluid depositing arrangement is disposed within printing system 10, such that fluid may be deposited thereby onto the guiding arrangement guiding the ITM, such as guiding channels 282 of FIG. 2B, or onto a portion of the ITM 210, such as the lateral formations 272 thereof (FIG. 2A) or any other portion thereof which contact the guiding arrangement.

Fluid may be pumped from fluid reservoir 304 to fluid depositing arrangement 302 by a pumping arrangement 306, which may be disposed at any suitable location within the printing system. Fluid reservoir 304 may be disposed in any suitable position or location within printing system 10, provided that it does not disrupt operating of the printing system, and that fluid may be pumped effectively to fluid depositing arrangement 302.

A control mechanism 308 is adapted to control operation of fluid depositing arrangement 302 and of pumping arrangement 306, so as to control depositing of fluid onto the guiding arrangement or onto the ITM. As explained in further detail hereinbelow, depositing of fluid onto the guiding arrangement or onto the ITM, at a contact area thereof, results in reduction of the friction between the guiding arrangement and the ITM.

Figure 5:
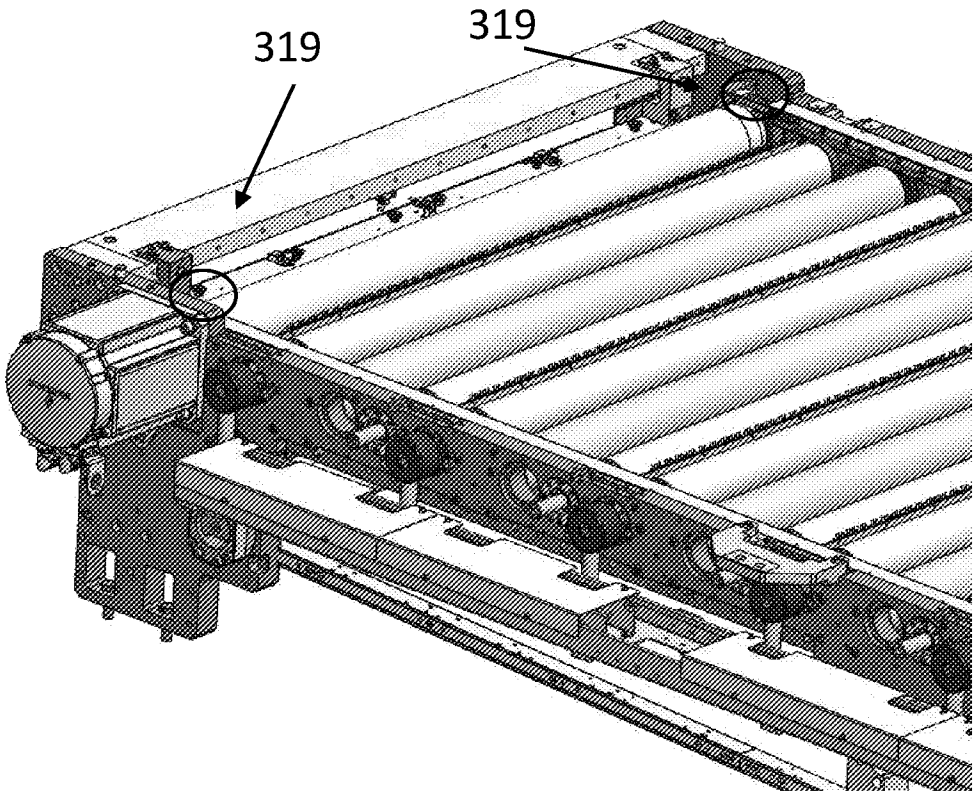
FIG. 5 is a perspective view illustration of a location of a fluid depositing arrangement forming part of a friction reduction system in accordance with an embodiment of the present invention.
Figure 4:
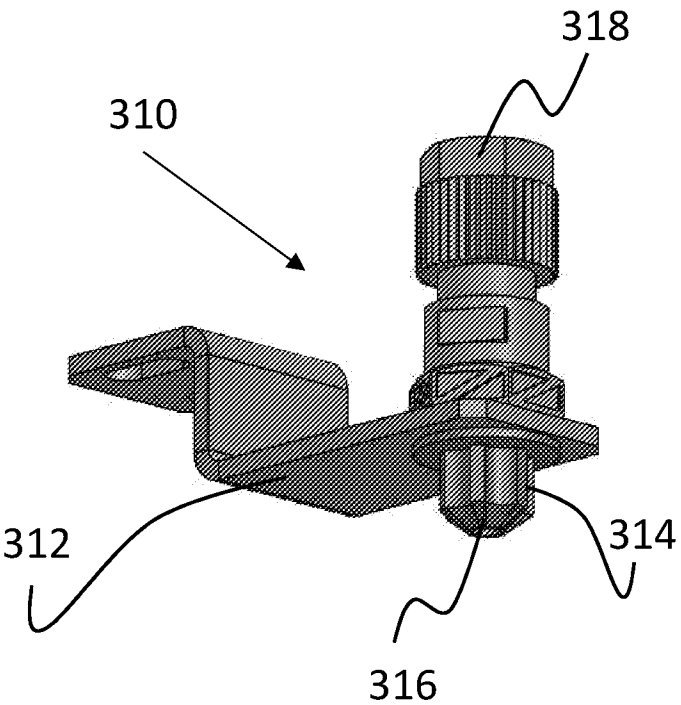
FIG. 4 is a perspective view illustration of a fluid depositing nozzle, forming part of a fluid depositing arrangement in accordance with an embodiment of the present invention.

Reference is now additionally made to FIG. 4, which is a perspective view illustration of a fluid depositing nozzle 310, forming part of a fluid depositing arrangement 302, and to FIG. 5, which is a perspective view illustration of a location of fluid depositing arrangement 302.

As seen in FIG. 4, in some embodiments fluid depositing arrangement 302 may include one or more fluid depositing nozzles 310, each in fluid flow communication with fluid reservoir 304 and suitable for depositing fluid therefrom. In some embodiments, fluid depositing arrangement may include at least two fluid depositing nozzles 310, one disposed adjacent each of guiding channels 282 and/or adjacent each of the two lateral edges of ITM 210.

Each fluid depositing nozzle 310 includes an anchoring arrangement 312 for anchoring the nozzle to printing system 10, a dripping tip 314 having a bore 316 sized and dimensioned for depositing fluid onto the ITM and/or the guiding arrangement, and an inlet portion 318 in fluid flow communication with fluid reservoir 304.

The dimensions of bore 316 may be suited to the specific type of fluid being deposited from nozzle 310, or to a depositing rate. For example, bore 316 may be larger if the fluid being deposited is a viscous emulsion, and may be smaller if the fluid being deposited is water. In some embodiments, bore 316 has a diameter in the range of 0.75 mm to 1.25 mm, preferably a diameter of 1 mm.

As seen in FIG. 5, in some embodiments, the fluid depositing arrangement 302, and more specifically fluid depositing nozzles 310, may be located adjacent, or above, each of lateral guiding channels 282, so as to deposit fluid onto the channels 282 or onto ITM 210 at an area which comes into contact with guiding channels 282. In some embodiments, the location of the two nozzles, on opposing sides of ITM 210, are substantially parallel to one another, as indicated by arrows 319 in FIG. 5.

In some embodiments, the fluid depositing arrangement 302 or fluid depositing nozzles 310 are located adjacent the image forming station of the printing system (e.g. image forming station 212 of FIG. 1). Such positioning of the fluid depositing nozzles 310 is advantageous due to the fact that, due to the high working temperature of the printing system, which may be 150° C., aqueous component of the deposited fluid evaporates prior to arriving at the impression station (e.g. impression station 216 of FIG. 1) such that the fluid does not degrade the quality of the printed image. It is appreciated that any other location of the nozzles 310, enabling evaporation of an aqueous component of the deposited fluid prior to arriving at the impression station, would be similarly advantageous.

In some embodiments, nozzles 310 may be located at other location, or in additional locations. For example, additional nozzles may be required if the deposited fluid evaporates rapidly, or if deposition of fluid at a single point along the path of ITM 210 in printing system 10 is insufficient for preventing an increase in friction between the ITM and the guiding channels 282.

Figure 6:
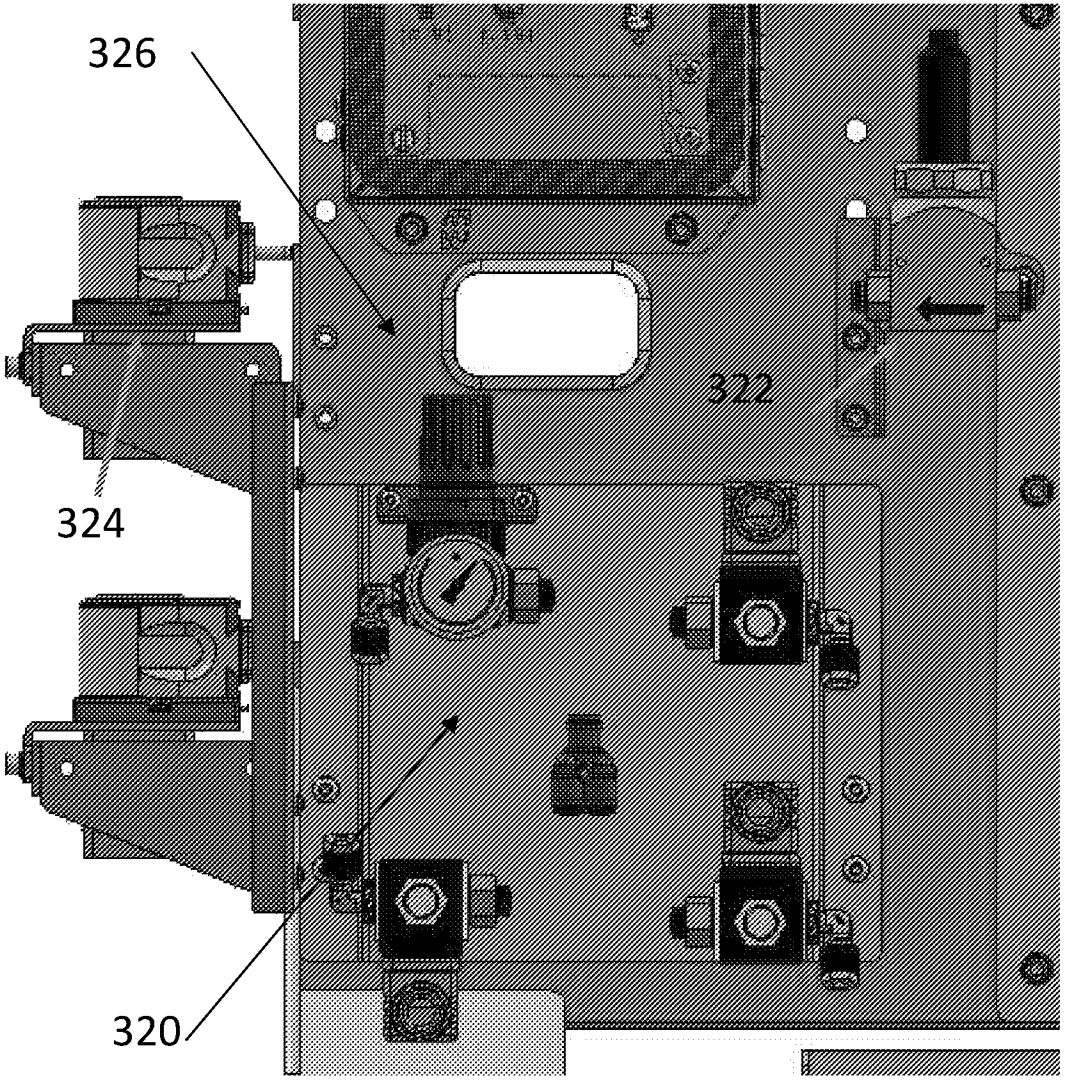
FIG. 6 is a perspective view illustration of a portion of a control mechanism forming part of a friction reduction system in accordance with an embodiment of the present invention.

Reference is now made to FIG. 6, which is a perspective view illustration of a portion of control mechanism 308 of friction reduction system 300 in accordance with an embodiment of the present invention. As seen in FIG. 6, control mechanism 308 may form part of a general control panel or logic panel of printing system 10, and may include a logic circuit 320, which may be part of a printed circuit board, and a flow meter 322 for controlling the flow of fluid from fluid depositing arrangement 302. One or more pumps 324, which may form part of pumping arrangement 306, may also be mounted onto control mechanism 308 or onto a control panel 326 of system 10, as illustrated in FIG. 6.

In some embodiments, the control mechanism 308 may include a dedicated processor (CPU). In other embodiments, the control mechanism 308 may run using the central processor of printing system 10. In some embodiments, the control mechanism 308 may include a dedicated memory component storing instructions to be executed by the processor. In other embodiments, the instructions to be carried out by the processor of control mechanism 308 may be stored on a central memory component of printing system 10. The printed circuit board associated with control mechanism 308 may be placed at any suitable location, for example the location illustrated in FIG. 6.

In use, fluid is deposited from fluid depositing arrangement 302 onto the guiding channels 282 (or other guiding arrangement) or onto a portion of ITM 210, for example, a portion thereof which comes into contact with the guiding arrangement, so as to reduce friction between said ITM and said guiding arrangement.

In some embodiments, the control mechanism 308 may control fluid depositing arrangement 302, such that the fluid is continuously deposited onto the ITM 210 and/or the guiding arrangement 280. In some embodiments, the fluid is continuously deposited at a fixed continuous fluid deposition rate, which may, for example, be in the range of 1 ml to 50 ml per hour. It will be appreciated that a fixed fluid deposition rate may be different for different types of fluids, for example due to different viscosities.

In some embodiments, the control mechanism 308 may control fluid depositing arrangement 302, such that the fluid is periodically deposited onto the ITM 210 and/or the guiding arrangement 280. In some embodiments, a fixed volume of the fluid is deposited at fixed intervals, for example at least once every 5 minutes, at least once every 10 minutes, at least once every 15 minutes, at least once every 30 minutes, or at least once every 45 minutes.

In some such embodiments, the fixed volume may be in the range of 1 ml to 50 ml. It will be appreciated that the fixed volume, and/or the fixed time interval, may be different for different types of fluids, for example due to different viscosities or to different lubricating characteristics.

In some embodiments, the control mechanism 308 may control fluid depositing arrangement 302, such that the fluid is intermittently deposited onto the ITM 210 and/or the guiding arrangement 280.

For example, the control mechanism 308 may identify an increase in friction between ITM 210 and guiding arrangement 280, such as identifying that such friction exceeds a pre-defined friction threshold. In response, the control mechanism may control fluid depositing arrangement 302 to deposit a volume of fluid into the ITM and/or guiding arrangement so as to lower the friction to be below the friction threshold. The degree of friction between the ITM and guiding arrangement may be tracked or monitored using any suitable method or technique. In some embodiments, the degree of friction is monitored by monitoring the electrical current in the printing system, where an increase in the electrical current corresponds to an increase in friction, as explained hereinbelow with respect to Example 1.

As another example, the control mechanism 308 may identify an increase in temperature of ITM 210 and/or of guiding arrangement 280, and in response, may control fluid depositing arrangement 302 to deposit a volume of fluid onto the guiding arrangement and/or the ITM. In some embodiments, in order to trigger depositing of fluid, the increase in temperature (i.e. the difference in temperature from a previous measurement to the current measurement) must be greater than a pre-defined increase threshold. In some embodiments, in order to trigger depositing of fluid, a temperature of the ITM or of the guiding arrangement must exceed a pre-defined temperature threshold. In some embodiments, the temperature measurement, or temperature increase measurement, is carried out at a specific temperature measurement region, which may be, for example, in a portion of the ITM which comes into contact with the guiding arrangement, or in a portion of the guiding arrangement which comes into contact with the ITM.

In some embodiments, control mechanism may trigger fluid depositing arrangement 302 to deposit fluid only following identification of a continuous increase in temperature of the ITM and/or of the guiding arrangement for a pre-defined duration.

As a further example, the control mechanism 308 may be functionally associated with a user interface of printing system 10 (not explicitly illustrated), and may receive from the user interface a user instruction causing the control mechanism to control fluid depositing arrangement 302 to deposit a volume of fluid onto the guiding arrangement and/or the ITM.

The volume of fluid deposited by fluid depositing arrangement 302 at each such intermittent depositing occurrence may be fixed, or may vary between different depositing occurrences. For example, a different volume of fluid may be used in response to receipt of a user instruction, than in response to identification of an increase in temperature or in friction. As another example, the volume of fluid deposited may be correlated to the degree of increase in temperature or in friction identified by control mechanism 308, such that identification of a greater increase in temperature or friction would result in deposition of a larger volume of fluid. In some embodiments, the volume of fluid deposited at each fluid depositing occurrence is in the range of 1 ml to 50 ml.

As described hereinabove with respect to FIGS. 4 and 5, in some embodiments, the fluid depositing arrangement 302 may include a plurality of fluid depositing locations, or fluid depositing nozzles, disposed at different locations along the guiding arrangement. In some such embodiments, when fluid is deposited onto ITM 210 and/or onto guiding arrangement 280, control mechanism 308 controls the fluid depositing arrangement 302 to deposit fluid in specific ones of the fluid depositing locations. As such, fluid may be deposited at all the fluid depositing locations simultaneously, or only at a subset of the fluid depositing locations at any specific time.

In some embodiments, the deposited fluid lubricates ITM 210 and/or onto guiding arrangement 280, which results in reduction of friction therebetween.

In some embodiments, as a result of deposition of fluid onto ITM 210 and/or onto guiding arrangement 280, at least the local temperature of at least a portion of the ITM and/or at least a portion of the guiding arrangement is decreased. As explained hereinabove, a reduction in temperature, results in a corresponding reduction of friction in the system. In this context, the term "local temperature" relates to the temperature at the point of contact between a portion of the ITM and a portion of the guiding arrangement in which the portion of the ITM is located. In some such embodiments, the portion of the ITM and/or the portion of the guiding arrangement may be portions at which the guiding arrangement and ITM engage one another.

The deposited fluid may be any suitable fluid.

In some embodiments, the deposited fluid is water. In some embodiments, the deposited fluid is pressurized air. In such embodiments, the deposition of fluid results in reduction of temperature as explained above, which in turn results in reduction of friction. Due to the fact that waster and/or pressurized air function by reduction of temperature, and that such reduction of temperature does not persist for an extended duration, and/or does not substantially occur in areas onto which no fluid was directly deposited, continuous depositing of fluid is more suitable and effective when using these types of fluids.

In some embodiments, the fluid is a lubricating fluid, which lubricates the contact area between the ITM and the guiding arrangement so as to reduce friction therebetween. For example, the lubricating fluid may comprise an aqueous emulsion. In such embodiments, periodic deposition of fluid is suitable, since the lubricating component of the emulsion remains in the guiding arrangement between deposition occurrences, and is spread along the ITM and the guiding arrangement also to areas where it was not directly deposited.

The emulsion may have any suitable ratio between lubricating components and aqueous components. In some embodiments, the emulsion comprises at least 70% water, at least 75% water, at least 80% water, at least 85% water, at least 90% water, or at least 95% water. In some embodiments, the emulsion comprises at most 30% lubricant, at most 25% lubricant, at most 20% lubricant, at most 15% lubricant, at most 10% lubricant, or at most 5% lubricant. In some embodiments, the emulsion comprises 90% water and 10% lubricant.

In some embodiments, the lubricant included in the emulsion is pure silicone.

In some embodiments, the deposited fluid also functions to clean the guiding arrangement. As shown in Example 2 below, an emulsion including pure silicone serves to clean the guiding channels 282 while lubricating the guiding channels and reducing friction between the guiding channels and the ITM.

The fluid used to reduce friction in printing system 10, and in the case of an emulsion also specifically the lubricant included therein, must be suitable to the functionality of the printing system.

As such, the selected fluid is chemically stable at a temperature at which the fluid is stored in printing system 10, which is a temperature in the range of 5 to 40 degrees Celsius.

In some embodiments, the selected fluid does not detrimentally affect printing quality or image transfer from the surface of the ITM to the substrate. Specifically, the selected fluid, or a lubricant contained therein, does not affect the wettability of the printing ink, or the tackiness during release of the ink from the ITM and image transfer.

In some embodiments, the selected fluid does not detrimentally affect characteristics of the ITM.

For example, in some embodiments in which the ITM includes a seam connecting opposing ends of an elongate flexible blanket to form the ITM, the selected fluid does not detrimentally affect the strength of the seam. For the purposes of this application, a fluid is considered to not detrimentally affect the strength of the seam if, under the same testing conditions, the force at which seam failure occurs, following use of the fluid at a rate of 10 cc of fluid deposited onto the ITM once every hour for a duration of 72 hours, is smaller than the force at which seam failure occurred prior to application of the fluid by at most 30%, at most 25%, at most 20%, at most 15%, at most 10%, or at most 5%.

As another example, in some embodiments in which the ITM includes lateral formations 272, as described hereinabove with respect to FIG. 2A, the selected fluid does not detrimentally affect the strength of a connection between the lateral formations and lateral edges of the ITM. For the purposes of this application, a fluid is considered to detrimentally affect the strength of the connection between the lateral formations and the lateral edges of the ITM if, under the same testing conditions, the peeling force at which failure occurs between the lateral formations and the lateral edges of the ITM, following use of the fluid at a rate of 10 cc of fluid deposited onto the ITM once every hour for a duration of 72 hours, is smaller than the peeling force at which such failure occurred prior to application of the fluid by at most 35%, at most 30%, at most 25%, at most 20%, at most 15%, at most 10%, or at most 5%.

As a further example, in some embodiments in which the ITM includes lateral formations 272, as described hereinabove with respect to FIG. 2A, the selected fluid does not detrimentally affect the spring constant of the lateral formations. For the purposes of this application, a fluid is considered to detrimentally affect the spring constant the lateral formations if, under the same testing conditions, the spring constant of the lateral formations measured following use of the fluid at a rate of 10 cc of fluid deposited onto the ITM once every hour for a duration of 72 hours, differs from the spring constant measured prior to application of the fluid by at most 15%, at most 10%, or at most 5%.

As yet another example, in some embodiments in which the ITM includes lateral formations 272, as described hereinabove with respect to FIG. 2A, the selected fluid does not substantially discolor the lateral formations. When printing system 10 is in use for printing an image onto a substrate, at printing station 212 (FIG. 1), an image is ink-jet printed a surface of ITM 210. The ITM is then rotated to move the printing image from the printing station to the impression station 216 (FIG. 1). At the impression station, the image is transferred from the surface of the ITM onto the substrate, as explained hereinabove. During one or more of the actions of printing the image, rotating the ITM, and transferring the image, friction between the ITM 210 and guiding arrangement 240 (FIG. 2B) is reduced by deposition of fluid onto the ITM or the guiding arrangement, as described hereinabove.

EXAMPLES

Reference is now made to the following examples, which together with the above description, illustrate the invention in a non-limiting fashion.

Example 1

Application of Emulsion Lowers Currents in the System

A printing system was operated to print images, while tracking the currents in the system approximately once every 2-3 minutes, on either side of the ITM of the system. After approximately 30 minutes of operation, 10 cc of an emulsion were deposited onto each of the guiding tracks of the printing system, adjacent the ITM. The emulsion was an aqueous emulsion, including 80% water and 10% liquid silicone in the form of PMX200, commercially available from Dow Corning of Midland, Mich., USA. Following deposition of the emulsion, the currents on either side of the ITM were measured for an additional duration of approximately three hours, with no additional application of the emulsion or any other fluid. The currents measured in the system are illustrated in FIG. 7, in which the currents measured on one side of the ITM are indicated in purple, and the currents measured on the other side of the ITM are indicated in green.

Figure 7:
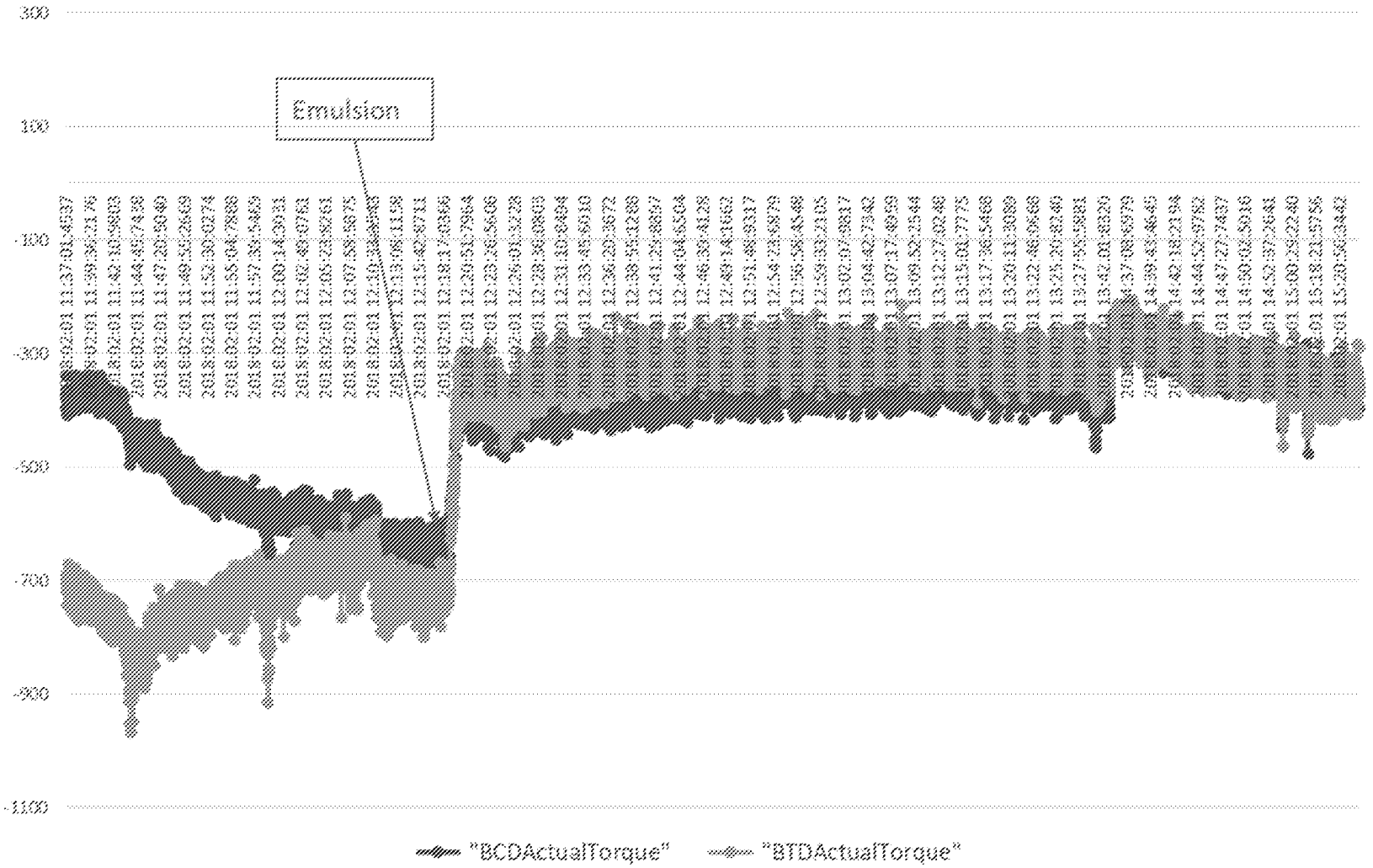
FIG. 7 is a graph indicating the impact to friction between the ITM and the guiding arrangement when an emulsion is deposited onto the guiding arrangement, using the system and method of the present invention.

In FIG. 7, the x-axis represents time, and the y-axis represents Torque, such that a lower absolute value along the y-axis is indicative of lower current in the system, and a higher absolute value is indicative of a higher current in the system.

As seen, in the initial 40 minutes of operation of the system, the currents increase—in the purple graph, or remain, on average, fixed—in the green graph. Upon deposition of the emulsion, the currents in the system almost immediately decrease by approximately 400 Nm, thereby indicating a significant reduction of friction between the ITM and the guiding channels. As seen, following deposition of the emulsion and the reduction in the currents in the system, the current stay substantially constant for the remainder of the experiment.

As such, the graph of FIG. 7 clearly demonstrates the effectiveness of a liquid silicone emulsion in reducing the friction between the ITM and the guiding tracks, for an extended duration, while using small volumes of the emulsion.

Example 2

Emulsions for Reducing Friction, as Cleaners

Figure 8A:
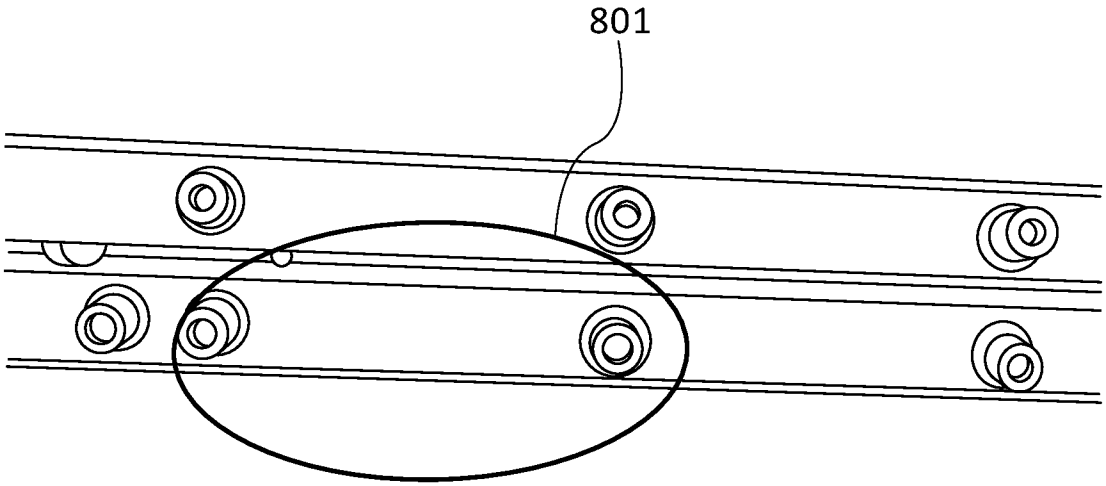
FIGS. 8A and 8B are photographs of a guiding channel in which a Polytetrafluoroethylene (PTFE) emulsion was used as the deposited fluid, and a guiding channel in which a silicone emulsion was used as the deposited fluid, respectively.

A dirty guiding track for an ITM in a printing system was cleaned using emulsions, which may also be used as lubricating fluids according to the present invention. A first segment of the guiding track was cleaned using an emulsion including 80% water and 10% liquid silicone in the form of PMX200, commercially available from Dow Corning of Midland, Mich., USA. The first segment is shown in the photograph of FIG. 8A, circled by an oval 801. A second segment of the guiding track was cleaned using a Polytetrafluoroethylene (PTFE) spray, commercially available as a Teflon® spray from The Chemours Company of Willmington, Del., USA. The second segment is shown in the photograph of FIG. 8B, circled by an oval 802.

Figure 8B:
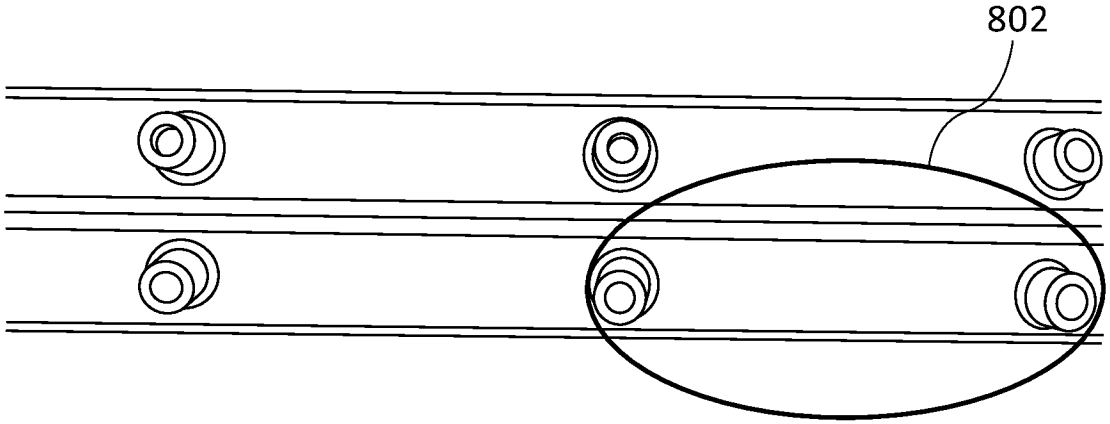

As seen from comparison of FIGS. 8A and 8B, the emulsion including PMX200 is a much more effective cleaner of the guiding track than the spray including Teflon®. Since, as shown in Example 1, an emulsion including PMX200 is an effective lubricant of the guiding track and the ITM, cleaning of the tracks during operation of the system is an added benefit that may occur when using, as the deposited fluid, an aqueous emulsion of PMX200.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the present disclosure has been described with respect to various specific embodiments presented thereof for the sake of illustration only, such specifically disclosed embodiments should not be considered limiting. Many other alternatives, modifications and variations of such embodiments will occur to those skilled in the art based upon Applicant's disclosure herein. Accordingly, it is intended to embrace all such alternatives, modifications and variations and to be bound only by the spirit and scope of the appended claims and any change which come within their meaning and range of equivalency.

In the description and claims of the present disclosure, each of the verbs "comprise", "include" and "have", and conjugates thereof, are used to indicate that the object or objects of the verb are not necessarily a complete listing of features, members, steps, components, elements or parts of the subject or subjects of the verb.

As used herein, the singular form "a", "an" and "the" include plural references and mean "at least one" or "one or more" unless the context clearly dictates otherwise.

Unless otherwise stated, the use of the expression "and/or" between the last two members of a list of options for selection indicates that a selection of one or more of the listed options is appropriate and may be made.

Unless otherwise stated, adjectives such as "substantially" and "about" that modify a condition or relationship characteristic of a feature or features of an embodiment of the present technology, are to be understood to mean that the condition or characteristic is defined to within tolerances that are acceptable for operation of the embodiment for an application for which it is intended.

The invention claimed is:

1. A friction reduction system for reducing friction between an intermediate transfer member (ITM) of a printing system and a guiding arrangement of the printing system, while the ITM is guided along the printing system by the guiding arrangement, the friction reduction system comprising:

a fluid reservoir mounted within said printing system;

a fluid depositing arrangement disposed at at least one position along the ITM; and a control mechanism, adapted to control depositing of fluid, from said fluid depositing arrangement onto said guiding arrangement or onto at least a portion of said ITM, wherein depositing of said fluid reduces friction between said ITM and said guiding arrangement.

2. The friction reduction system of claim 1, wherein said control mechanism is adapted to control deposition of fluid from said fluid depositing arrangement onto said ITM at a contact area between said ITM and said guiding arrangement.

3. The friction reduction system of claim 1, wherein said control mechanism is adapted to control said fluid depositing arrangement such that said fluid is continuously deposited onto said guiding arrangement or onto said at least a portion of said ITM.

4. The friction reduction system of claim 1, wherein said control mechanism is adapted to control said fluid depositing arrangement such that fluid is periodically deposited from said fluid depositing arrangement onto said guiding arrangement or onto said at least a portion of said ITM.

5. The friction reduction system of claim 1, wherein said control mechanism is adapted to control said fluid depositing arrangement to deposit fluid in response to at least one of:

identification of an increase in friction between said ITM and said guiding arrangement; and identification of an increase in temperature of the ITM or of the guiding arrangement at a region of interface between said ITM and said guiding arrangement.

6. The friction reduction system of claim 1, wherein said control mechanism is functionally associated with a user interface, and is adapted to control said fluid depositing arrangement to deposit fluid in response to receipt of a corresponding user instruction.

7. The friction reduction system of claim 1, wherein said fluid deposited onto said guiding arrangement or onto said at least a portion of said ITM is adapted to reduce friction by reducing at least a local temperature of at least a portion of said ITM or of at least a portion of said guiding arrangement, at a region of engagement between said ITM and said guiding arrangement.

8. The friction reduction system of claim 1, wherein said fluid deposited onto said guiding arrangement or onto said at least a portion of said ITM is adapted to reduce friction by lubricating a contact area of said ITM and said guiding arrangement.

9. The friction reduction system of claim 8, wherein said fluid comprises an aqueous emulsion, and wherein at least one of the following is true:

said aqueous emulsion comprises at least 70% water, at least 75% water, at least 80% water, at least 85% water, at least 90% water, or at least 95% water;

said aqueous emulsion comprises at most 30% lubricant, at most 25% lubricant, at most 20% lubricant, at most 15% lubricant, at most 10% lubricant, or at most 5% lubricant; and a lubricant of said aqueous emulsion comprises pure silicone.

10. The friction reduction system of claim 9, wherein said lubricant is further adapted to clean the guiding arrangement.

11. The friction reduction system of claim 9, wherein said lubricant is chemically stable at at least one of:

a temperature at which said fluid is stored in the printing system; and a temperature in the range of 5 to 40 degrees Celsius.

12. A printing system comprising:

an intermediate transfer member (ITM) formed as an endless belt;

an image forming station at which droplets of an ink are applied to an outer surface of said ITM to form an ink image;

a drying station for drying the ink image to leave an ink residue film;

an impression station at which the residue film is transferred to a substrate;

a guiding arrangement, having lateral edges of said ITM guided therealong for guiding said ITM from said image forming station, via said drying station, to said impression station; and the friction reduction system of claim 1.

13. A method of reducing friction between an intermediate transfer member (ITM) of a printing system and a guiding arrangement through which the ITM is guided along the printing system, the method comprising:

depositing a fluid from a fluid deposition system, onto said guiding arrangement or onto at least a portion of said ITM, at or adjacent a contact area between said guiding arrangement and said ITM, thereby to reduce friction between said ITM and said guiding arrangement.

14. The method of claim 13, wherein said depositing comprises continuously depositing said fluid, at a fixed continuous fluid deposition rate.

15. The method of claim 13, wherein depositing comprises periodically depositing said fluid by depositing a fixed volume of said fluid at least every 5 minutes, at least every 10 minutes, at least every 15 minutes, at least every 30 minutes, or at least every 45 minutes.

16. The method of claim 13, wherein said depositing comprises intermittently depositing said fluid.

17. The method of claim 13, wherein said depositing said fluid causes reducing at least a local temperature of at least a portion of said ITM or of at least a portion of said guiding arrangement at said contact area.

18. The method of claim 13, wherein said depositing said fluid comprises lubricating a contact area of said ITM and said guiding arrangement.

19. The method of claim 18, wherein said fluid comprises an aqueous emulsion, wherein at least one of the following is true:

said aqueous emulsion comprises at least 70% water, at least 75% water, at least 80% water, at least 85% water, at least 90% water, or at least 95% water;

said aqueous emulsion comprises at most 30% lubricant, at most 25% lubricant, at most 20% lubricant, at most 15% lubricant, at most 10% lubricant, or at most 5% lubricant; and a lubricant of said aqueous emulsion comprises pure silicone and wherein said depositing said fluid further comprises cleaning the guiding arrangement.

20. A method of printing an image onto a substrate in a printing system including an intermediate transfer member (ITM) guided by a guiding arrangement between a printing station and an impression station, the method comprising:

ink-jet printing an image onto a surface of said ITM;

rotating said ITM to move said image from the printing station to the impression station;

transferring said image from said surface of said ITM onto the substrate; and during at least one of said printing, said rotating, and said transferring, reducing friction between said ITM and said guiding arrangement according to the method of claim 13.

* * * * *